US009089163B2

(12) United States Patent
Le Roux

(10) Patent No.: US 9,089,163 B2
(45) Date of Patent: Jul. 28, 2015

(54) FEED MECHANISM

(75) Inventor: Gerhard Le Roux, Stellenbosch (ZA)

(73) Assignee: Tobacco Research and Development Institute (Proprietary) Limited, Stellenbosch (ZA)

( * ) Notice: Subject to any disclaimer, the term of this patent is extended or adjusted under 35 U.S.C. 154(b) by 0 days.

(21) Appl. No.: 13/990,174

(22) PCT Filed: Nov. 30, 2011

(86) PCT No.: PCT/EP2011/071374

§ 371 (c)(1),
(2), (4) Date: Jun. 27, 2013

(87) PCT Pub. No.: WO2012/072676

PCT Pub. Date: Jun. 7, 2012

(65) Prior Publication Data

US 2013/0266406 A1 Oct. 10, 2013

(30) Foreign Application Priority Data

Dec. 1, 2010 (ZA) ..... 2010/08663

(51) Int. Cl.
*A24D 3/02* (2006.01)
*A24D 3/06* (2006.01)

(52) U.S. Cl.
CPC ..... *A24D 3/02* (2013.01); *A24D 3/0216* (2013.01); *A24D 3/061* (2013.01)

(58) Field of Classification Search
CPC ..... A24D 3/0225; A24D 3/061; A24D 3/022; A24D 3/041; A24D 3/0295; A24D 3/0287; A24D 3/0245; A24D 3/02
See application file for complete search history.

(56) References Cited

U.S. PATENT DOCUMENTS

| | | | |
|---|---|---|---|
| 1,726,737 | A | 9/1929 | Harris |
| 2,755,206 | A | 7/1956 | Statia, Sr. |
| 2,863,461 | A | 12/1958 | Frost, Jr. |
| 3,339,558 | A | 9/1967 | Waterbury |
| 3,366,121 | A | 1/1968 | Carty |
| 3,390,686 | A | 7/1968 | Irby, Jr. et al. |
| 3,428,049 | A | 2/1969 | Cogbill |
| 3,502,084 | A | 3/1970 | Carty |

(Continued)

FOREIGN PATENT DOCUMENTS

| | | | |
|---|---|---|---|
| DE | 102007043776 | A1 | 3/2009 |
| EP | 636324 | B1 | 4/1998 |

(Continued)

OTHER PUBLICATIONS

International Search Report and Written Opinion, mailed Apr. 3, 2012, for PCT International Application No. PCT/EP2011/071374, filed Nov. 30, 2011.

(Continued)

*Primary Examiner* — Sameh Tawfik
(74) *Attorney, Agent, or Firm* — NW Poulsen; LA Pinol

(57) ABSTRACT

A feed mechanism to feed objects for insertion into tobacco industry products includes a rotary member for receiving objects, the rotary member having a plurality of channels, each channel being configured such that in use objects assemble in a row in the channel which rotates with the rotary member, each channel having an outlet for dispensing an object from the channel, and a pneumatic mechanism configured to hold an object in a row prior to the object being dispensed.

23 Claims, 25 Drawing Sheets

(56) References Cited

U.S. PATENT DOCUMENTS

| | | | |
|---|---|---|---|
| 3,513,859 | A | 5/1970 | Carty |
| 3,525,582 | A | 8/1970 | Waterbury |
| 3,547,130 | A | 12/1970 | Flint |
| 3,550,508 | A | 12/1970 | Wartman, Jr. et al. |
| 3,884,246 | A | 5/1975 | Walker et al. |
| 4,865,056 | A | 9/1989 | Tamaoki et al. |
| 4,889,144 | A | 12/1989 | Tateno et al. |
| 4,903,714 | A | 2/1990 | Barnes et al. |
| 4,913,166 | A | 4/1990 | Christensson |
| 4,966,169 | A | 10/1990 | Waddell et al. |
| 4,967,772 | A | 11/1990 | Waddell et al. |
| 4,991,605 | A | 2/1991 | Keritsis |
| 5,000,198 | A | 3/1991 | Nakajima |
| 5,016,655 | A | 5/1991 | Waddell et al. |
| 5,052,413 | A | 10/1991 | Baker et al. |
| 5,060,673 | A | 10/1991 | Lehman |
| 5,065,800 | A | 11/1991 | Sagawa et al. |
| 5,067,500 | A | 11/1991 | Keritsis |
| 5,074,321 | A | 12/1991 | Gentry et al. |
| 5,085,232 | A | 2/1992 | Raker et al. |
| 5,101,839 | A | 4/1992 | Jakob et al. |
| 5,105,836 | A | 4/1992 | Gentry et al. |
| 5,113,878 | A | 5/1992 | Polese |
| 5,129,408 | A | 7/1992 | Jakob et al. |
| 5,131,416 | A | 7/1992 | Gentry |
| 5,133,367 | A | 7/1992 | Keritsis |
| 5,137,034 | A | 8/1992 | Perfetti et al. |
| 5,139,056 | A | 8/1992 | Sagawa et al. |
| 5,141,007 | A | 8/1992 | Raker et al. |
| 5,144,966 | A | 9/1992 | Washington |
| 5,159,944 | A | 11/1992 | Arzonico et al. |
| 5,176,154 | A | 1/1993 | Sagawa et al. |
| 5,186,185 | A | 2/1993 | Mashiko et al. |
| 5,221,502 | A | 6/1993 | Washington |
| 5,261,425 | A | 11/1993 | Raker et al. |
| 5,271,419 | A | 12/1993 | Arzonico et al. |
| 5,327,917 | A | 7/1994 | Lekwauwa |
| 5,331,981 | A | 7/1994 | Tamaoki et al. |
| 5,360,023 | A | 11/1994 | Blakley et al. |
| 5,396,911 | A | 3/1995 | Casey et al. |
| 5,415,186 | A | 5/1995 | Casey et al. |
| 5,472,002 | A | 12/1995 | Covarrubias |
| 5,479,949 | A | 1/1996 | Battard et al. |
| 5,494,055 | A | 2/1996 | Noe et al. |
| 5,501,238 | A | 3/1996 | Von Borstel et al. |
| 5,549,124 | A | 8/1996 | Dorsey |
| 5,598,868 | A | 2/1997 | Jakob et al. |
| 5,662,126 | A | 9/1997 | Charlton et al. |
| 5,724,997 | A | 3/1998 | Smith et al. |
| 5,746,231 | A | 5/1998 | Lesser et al. |
| 5,829,449 | A | 11/1998 | Hersh et al. |
| 5,839,447 | A | 11/1998 | Lesser et al. |
| 5,860,428 | A | 1/1999 | Lesser et al. |
| 5,975,086 | A | 11/1999 | Lesser et al. |
| 6,079,418 | A | 6/2000 | Russo |
| 6,082,370 | A | 7/2000 | Russo |
| 6,138,683 | A | 10/2000 | Hersh et al. |
| 6,164,288 | A | 12/2000 | Lesser et al. |
| 6,325,859 | B1 | 12/2001 | De Roos et al. |
| 6,415,798 | B1 | 7/2002 | Hersh et al. |
| 6,443,160 | B1 | 9/2002 | Boldrini et al. |
| 6,470,894 | B2 | 10/2002 | Hersh et al. |
| 6,516,809 | B1 | 2/2003 | Schumacher |
| 6,530,377 | B1 | 3/2003 | Lesser et al. |
| 6,584,980 | B1 | 7/2003 | Russo |
| 6,631,722 | B2 | 10/2003 | MacAdam et al. |
| 6,732,740 | B2 | 5/2004 | Schumacher |
| 6,792,953 | B2 | 9/2004 | Lesser et al. |
| 6,805,174 | B2 | 10/2004 | Smith et al. |
| 6,883,523 | B2 | 4/2005 | Dante |
| 7,093,625 | B2 | 8/2006 | Smith et al. |
| 7,104,265 | B2 | 9/2006 | Von Borstel |
| 7,115,085 | B2 | 10/2006 | Deal |
| 7,237,558 | B2 | 7/2007 | Clark et al. |
| 7,240,678 | B2 | 7/2007 | Crooks et al. |
| 7,249,605 | B2 | 7/2007 | MacAdam et al. |
| 7,479,098 | B2 | 1/2009 | Thomas et al. |
| 7,479,099 | B2 | 1/2009 | Scott et al. |
| 7,546,839 | B2 | 6/2009 | Markel |
| 7,578,298 | B2 | 8/2009 | Karles et al. |
| 7,654,945 | B2 | 2/2010 | Deal |
| 7,669,604 | B2 | 3/2010 | Crooks et al. |
| 7,673,557 | B2 | 3/2010 | Bienvenu et al. |
| 7,713,184 | B2 | 5/2010 | Scott et al. |
| 7,744,922 | B2 | 6/2010 | Mane et al. |
| 7,754,239 | B2 | 7/2010 | Mane et al. |
| 7,757,835 | B2 | 7/2010 | Garthaffner et al. |
| 7,789,089 | B2 | 9/2010 | Dube et al. |
| 7,793,665 | B2 | 9/2010 | Dube et al. |
| 7,810,508 | B2 | 10/2010 | Wyss-Peters et al. |
| 7,827,997 | B2 | 11/2010 | Crooks et al. |
| 7,833,146 | B2 | 11/2010 | Deal |
| 7,836,895 | B2 | 11/2010 | Dube et al. |
| 7,856,989 | B2 | 12/2010 | Karles et al. |
| 7,856,990 | B2 | 12/2010 | Crooks et al. |
| 7,972,254 | B2 | 7/2011 | Stokes et al. |
| 7,975,877 | B2 | 7/2011 | Garthaffner et al. |
| 7,984,719 | B2 | 7/2011 | Dube et al. |
| 7,998,274 | B2 | 8/2011 | Rodrigues et al. |
| 8,066,011 | B2 | 11/2011 | Clark et al. |
| 8,079,369 | B2 | 12/2011 | Andresen et al. |
| 8,142,339 | B2 | 3/2012 | Deal |
| 8,157,918 | B2 | 4/2012 | Becker et al. |
| 8,186,359 | B2 | 5/2012 | Ademe et al. |
| 8,235,056 | B2 | 8/2012 | Zhuang et al. |
| 8,262,550 | B2 | 9/2012 | Barnes et al. |
| 8,303,474 | B2 | 11/2012 | Iliev et al. |
| 8,353,811 | B2 | 1/2013 | Shen et al. |
| 8,381,947 | B2 | 2/2013 | Garthaffner et al. |
| 8,459,272 | B2 | 6/2013 | Karles et al. |
| 8,470,215 | B2 | 6/2013 | Zhang |
| 8,496,011 | B2 | 7/2013 | Andresen et al. |
| 8,512,213 | B2 | 8/2013 | Deal |
| 2002/0117180 | A1 | 8/2002 | Hersh et al. |
| 2002/0179103 | A1 | 12/2002 | Hersh et al. |
| 2003/0087566 | A1 | 5/2003 | Carlyle et al. |
| 2003/0098033 | A1 | 5/2003 | MacAdam |
| 2003/0106561 | A1 | 6/2003 | Schumacher |
| 2003/0183239 | A1 | 10/2003 | Lesser et al. |
| 2004/0020554 | A1 | 2/2004 | Smith et al. |
| 2004/0032036 | A1 | 2/2004 | Subramaniam et al. |
| 2004/0074507 | A1 | 4/2004 | MacAdam et al. |
| 2004/0159327 | A1 | 8/2004 | Dante |
| 2004/0173227 | A1 | 9/2004 | Von Borstel |
| 2004/0234590 | A1 | 11/2004 | Mane et al. |
| 2004/0261807 | A1 | 12/2004 | Dube |
| 2005/0000531 | A1 | 1/2005 | Shi |
| 2005/0066980 | A1 | 3/2005 | Crooks et al. |
| 2005/0066981 | A1 | 3/2005 | Crooks et al. |
| 2005/0066982 | A1 | 3/2005 | Clark |
| 2005/0066983 | A1 | 3/2005 | Clark et al. |
| 2005/0066984 | A1 | 3/2005 | Crooks |
| 2005/0070409 | A1 | 3/2005 | Deal |
| 2005/0112228 | A1 | 5/2005 | Smith et al. |
| 2005/0123601 | A1 | 6/2005 | Mane et al. |
| 2005/0123757 | A1 | 6/2005 | Subramaniam |
| 2005/0166933 | A1 | 8/2005 | Lesser et al. |
| 2005/0268926 | A1 | 12/2005 | Hsu |
| 2006/0112963 | A1 | 6/2006 | Scott et al. |
| 2006/0112964 | A1 | 6/2006 | Jupe et al. |
| 2006/0144412 | A1 | 7/2006 | Mishra et al. |
| 2006/0157075 | A1 | 7/2006 | Gauthier |
| 2006/0174901 | A1 | 8/2006 | Karles et al. |
| 2006/0207616 | A1 | 9/2006 | Hapke et al. |
| 2006/0225754 | A1 | 10/2006 | Markel |
| 2006/0225755 | A1 | 10/2006 | Markel |
| 2006/0264130 | A1 | 11/2006 | Karles et al. |
| 2006/0272663 | A1 | 12/2006 | Dube |
| 2006/0278249 | A1 | 12/2006 | Von Borstel |
| 2006/0289023 | A1 | 12/2006 | Von Borstel |
| 2006/0293157 | A1 | 12/2006 | Deal |
| 2007/0012327 | A1 | 1/2007 | Karles et al. |
| 2007/0068540 | A1 | 3/2007 | Thomas |
| 2007/0084476 | A1 | 4/2007 | Yang et al. |

(56) References Cited

U.S. PATENT DOCUMENTS

| | | | |
|---|---|---|---|
| 2007/0095357 | A1 | 5/2007 | Besso et al. |
| 2007/0119467 | A1 | 5/2007 | Akhmetshin et al. |
| 2007/0181140 | A1 | 8/2007 | Xue et al. |
| 2007/0227548 | A1 | 10/2007 | Crooks |
| 2007/0246054 | A1 | 10/2007 | Gedevanishvili et al. |
| 2007/0267033 | A1 | 11/2007 | Mishra et al. |
| 2007/0284012 | A1 | 12/2007 | Smith et al. |
| 2008/0017206 | A1 | 1/2008 | Becker et al. |
| 2008/0029106 | A1 | 2/2008 | Mishra et al. |
| 2008/0029111 | A1 | 2/2008 | Dube et al. |
| 2008/0047571 | A1 | 2/2008 | Braunshteyn et al. |
| 2008/0142028 | A1 | 6/2008 | Fagg |
| 2008/0156336 | A1 | 7/2008 | Wyss-Peters et al. |
| 2008/0163877 | A1 | 7/2008 | Zhuang et al. |
| 2008/0163879 | A1 | 7/2008 | Rodrigues et al. |
| 2008/0173320 | A1 | 7/2008 | Dunlap et al. |
| 2008/0230076 | A1 | 9/2008 | Wick et al. |
| 2008/0302373 | A1 | 12/2008 | Stokes et al. |
| 2008/0302376 | A1 | 12/2008 | Karles et al. |
| 2008/0314399 | A1 | 12/2008 | Ricketts et al. |
| 2009/0038628 | A1 | 2/2009 | Shen et al. |
| 2009/0038629 | A1 | 2/2009 | Ergle et al. |
| 2009/0039102 | A1 | 2/2009 | Garthaffner et al. |
| 2009/0050163 | A1 | 2/2009 | Hartmann et al. |
| 2009/0071488 | A1 | 3/2009 | Markel |
| 2009/0090372 | A1 | 4/2009 | Thomas et al. |
| 2009/0118109 | A1 | 5/2009 | Scott et al. |
| 2009/0145724 | A1 | 6/2009 | Garthaffner et al. |
| 2009/0166376 | A1 | 7/2009 | Garthaffner et al. |
| 2009/0194118 | A1 | 8/2009 | Ademe et al. |
| 2009/0208568 | A1 | 8/2009 | Hannetel et al. |
| 2009/0277465 | A1 | 11/2009 | Karles et al. |
| 2009/0288667 | A1 | 11/2009 | Andresen et al. |
| 2009/0288669 | A1 | 11/2009 | Hutchens |
| 2009/0288672 | A1 | 11/2009 | Hutchens |
| 2009/0293894 | A1 | 12/2009 | Cecchetto et al. |
| 2009/0304784 | A1 | 12/2009 | Mane et al. |
| 2010/0108081 | A1 | 5/2010 | Blevins et al. |
| 2010/0108084 | A1 | 5/2010 | Norman et al. |
| 2010/0184576 | A1 | 7/2010 | Prestia et al. |
| 2010/0210437 | A1 | 8/2010 | Scott et al. |
| 2010/0236561 | A1 | 9/2010 | Barnes et al. |
| 2010/0294290 | A1 | 11/2010 | Zhang |
| 2011/0023896 | A1 | 2/2011 | Dube |
| 2011/0036367 | A1 | 2/2011 | Saito |
| 2011/0053745 | A1 | 3/2011 | Iliev et al. |
| 2011/0059831 | A1 | 3/2011 | Deal |
| 2011/0100387 | A1 | 5/2011 | Karles |
| 2011/0162662 | A1 | 7/2011 | Nikolov et al. |
| 2011/0162665 | A1 | 7/2011 | Burov et al. |
| 2011/0230320 | A1 | 9/2011 | Stokes et al. |
| 2012/0037173 | A1 | 2/2012 | Clark et al. |
| 2012/0061025 | A1 | 3/2012 | Andresen et al. |
| 2012/0088643 | A1 | 4/2012 | Thomas et al. |
| 2012/0167905 | A1 | 7/2012 | Becker et al. |
| 2012/0220438 | A1 | 8/2012 | Herholdt et al. |
| 2012/0270710 | A1 | 10/2012 | Deal |
| 2012/0298120 | A1 | 11/2012 | Barnes et al. |
| 2012/0302416 | A1 | 11/2012 | Barnes et al. |
| 2013/0029822 | A1 | 1/2013 | Iliev |
| 2013/0180534 | A1 | 7/2013 | Shen et al. |

FOREIGN PATENT DOCUMENTS

| | | | |
|---|---|---|---|
| GB | 2461858 | A | 1/2010 |
| JP | 03198766 | A | 8/1991 |
| JP | 08182492 | A | 7/1996 |
| JP | 2000014377 | A | 1/2000 |
| JP | 2005318806 | A | 11/2005 |
| JP | 4207188 | B2 | 1/2009 |
| JP | 2009504175 | A | 2/2009 |
| WO | 9409653 | A1 | 5/1994 |
| WO | 0110252 | A1 | 2/2001 |
| WO | 0135918 | A1 | 5/2001 |
| WO | 0243513 | A1 | 6/2002 |
| WO | 0247498 | A1 | 6/2002 |
| WO | 03009711 | A1 | 2/2003 |
| WO | 2005/032286 | A2 | 4/2005 |
| WO | 2007060543 | A2 | 5/2007 |
| WO | 2009034232 | A1 | 3/2009 |
| WO | 2009036851 | A2 | 3/2009 |
| WO | 2009/071272 | A1 | 6/2009 |
| WO | 2009094859 | A1 | 8/2009 |
| WO | 2009098462 | A1 | 8/2009 |
| WO | 2009157240 | A1 | 12/2009 |
| WO | 2010/103000 | A1 | 9/2010 |
| WO | 2010/115829 | A1 | 10/2010 |
| WO | 2011028372 | A1 | 3/2011 |
| WO | 2011/083405 | A1 | 11/2011 |

OTHER PUBLICATIONS

International Preliminary Report on Patentability, mailed Jan. 22, 2013, for PCT Internatinal Application No. PCT/EP2011/071374, filed Nov. 30, 2011.

FEED MECHANISM

CLAIM FOR PRIORITY

This application is a National Stage Entry entitled to and hereby claiming priority under 35 U.S.C. §§365 and 371 to corresponding PCT Application No. PCT/EP2011/071374, filed Nov. 30, 2011, which in turn claims priority to South African Application No. ZA2010/08663, filed Dec. 1, 2010. The entire contents of the aforementioned applications are herein expressly incorporated by reference.

FIELD OF THE INVENTION

This invention relates to tobacco industry machines. In particular, but not exclusively, it relates to a feed mechanism to feed objects for insertion into tobacco industry products such as cigarettes.

BACKGROUND TO THE INVENTION

Filter rods for use in the manufacture of filtered cigarettes are manufactured by filter rod making machinery such as the KDF-2 filter maker from Hauni Maschinenbau AG. In a filter maker, cellulose acetate filter plug material, referred to as tow, is drawn along a path from a source and subsequently compressed and paper wrapped in a garniture to form an elongate wrapped rod, which is cut to form individual rods. This rod forming process is well known per se to those skilled in the art.

It is also known to provide a filtered cigarette having a breakable menthol-containing capsule within the filter. The smoke from the cigarette may be selectively flavoured by squeezing the filter, thereby breaking the capsule and releasing the menthol. Thus the cigarette provides a choice as to whether to flavour the smoke with menthol or not.

Breakable capsules are conventionally incorporated into smoking article filter rods by dispensing individual capsules one by one from a delivery wheel into a flow of tow as it passes through a filter rod making machine.

SUMMARY OF THE INVENTION

The present invention provides a feed mechanism to feed objects for insertion into tobacco industry products, comprising a rotary member for receiving objects, the rotary member having a plurality of channels, each channel being adapted so that in use objects assemble in a row in the channel which rotates with the rotary member, each channel having an outlet for dispensing an object from the channel, and a pneumatic mechanism configured to hold an object in a row prior to the object being dispensed.

As used herein, the term "pneumatic mechanism" refers to any mechanism which employs suction and/or gaseous flow for holding an object prior to the object being dispensed. Suitable mechanisms include vacuum mechanisms for applying negative pressure to hold the objects, or compressed air mechanisms or the like for applying positive pressure for the same purpose.

Preferably, the objects are breakable fluid-containing capsules.

The pneumatic mechanism controls capsule movement along the channels by selectively holding capsules in position, thereby to facilitate a regular capsule feed from the feed mechanism.

The feed mechanism results in low impact/stress on the capsules, which allows a high speed feed without causing damage to the capsules. In particular, holding the capsules by way of suction and/or gaseous flow prior to the capsules being dispensed ensures gentle capsule handling.

Preferably, the feed mechanism comprises first and second rotary members, the first rotary member comprising said channels and the second rotary member comprising capsule-receiving pockets for receiving capsules from the channels. The second rotary member may be configured to successively deliver capsules into a flow of tow.

Preferably, the first rotary member is configured to rotate about a first axis and the second rotary member is configured to rotate about a second axis transverse to the first axis. Preferably, the feed mechanism comprises a synchronisation mechanism configured to synchronise rotation of the rotary members so that in use objects pass successively from successive channels of the first rotary member to successive pockets of the second rotary member. Preferably, the synchronisation mechanism ensures that the tangential velocity of the first rotary member is equal to the tangential velocity of the second rotary member at the point of capsule transfer from the first rotary member to the second. This ensures gentle handling of the capsules during transfer, even at high speed, since there is no capsule impact in the tangential direction. This in turn reduces the risk of cracked capsules in the eventual filter rod.

Preferably, the first rotary member is substantially horizontally oriented and the second rotary member is substantially vertically-oriented. Preferably, objects are delivered from the horizontally oriented rotary member to the vertically-oriented rotary member in a substantially vertical direction. Preferably, the horizontally-oriented rotary member rotates anti-clockwise, while the vertically-oriented rotary member rotates clockwise, or vice versa.

Preferably, the channels guide objects towards the periphery of the rotary member. The channels preferably extend in a direction transverse to the axis of rotation of the rotary member. Preferably the channels and the rows extend radially outwards with respect to the centre of rotation of the rotary member. Alternatively, the channels and rows may be deviate from a radial path and may be curved. Preferably the rotary member rotates around a substantially vertical axis.

Preferably, rotation of the rotary member successively brings each channel into a dispensing position.

The pneumatic mechanism may apply negative pressure to hold the capsules in the rotating channels, or may alternatively apply positive pressure for this purpose.

However, preferably the pneumatic mechanism is a suction mechanism.

The suction mechanism is preferably configured to release suction so as to allow an object to pass through the outlet of a channel when said channel is in the dispensing position, and to apply suction so as to prevent an object from passing through the outlet prior to the object being dispensed.

The suction mechanism preferably includes an intake region, the rotary member being configured to rotate relative to the intake region. Preferably each channel has one or more ports for alignment with the intake region so that in use, suction is applied through a port when said port is aligned with the intake region. The one or more ports each preferably comprise an aperture formed in the channel.

The suction mechanism is preferably configured to restrict outward movement of objects in a channel while an object in said channel is being dispensed. This ensures that a predetermined number of objects are dispensed from a channel when positioned in the dispensing position.

Preferably, each channel is adapted to confine objects in a single-file row in the channel during rotation of the rotary member.

The suction mechanism is preferably configured to release suction on an outermost object in a channel so that the outermost object can be dispensed when the channel is positioned in the dispensing position. The suction mechanism is preferably configured for holding the second outermost object in the channel while the outermost object is being dispensed. This configuration ensures that only the outermost object is dispensed from a channel when the channel is positioned in the dispensing position.

Preferably, the sidewalls of the channels are adapted to laterally confine objects in the channels. Further preferably, the channels are enclosed channels having sidewalls and a ceiling. The ceiling ensures that objects are maintained in the channels during rotation.

Preferably, the rotary member is formed of one or more plates. The channels may be defined by grooves formed in one of the plates.

Further preferably the rotary member is formed of an upper plate and a lower plate.

Forming the rotary member in two parts facilitates machining grooves in the upper plate to define the channels, and also facilitates machining the lower plate to obtain a desired profile.

The rotary member may comprise a first input arranged so that objects received in the first input pass into a first set of one or more channels and a second input arranged so that objects received in the second input pass into a second set of one or more channels.

The rotary member preferably includes one or more barriers arranged to prevent objects from passing from the first input member into any of the second set of channels and to prevent objects from passing from the second input member into any of the first set of channels. The one or more barriers may comprise internal walls of the rotary member.

The feed mechanism preferably comprises a gaseous flow generating mechanism configured to generate a gaseous flow to expel an object when the channel is positioned in the dispensing position.

The gaseous flow generating mechanism may comprise an air-jet mechanism configured to direct an air jet at the object to eject the object. Alternatively, or in addition, the gaseous flow generating mechanism may comprise a vacuum suction mechanism to suck the object from the channel when the channel is positioned in the dispensing position, thereby to dispense the object.

The invention also provides a method of feeding objects for insertion into tobacco industry products, comprising rotating a rotary member having a plurality of channels so that objects assemble in rows in the channels which rotate with the rotary member, holding an object in a row by suction and/or gaseous flow prior to the object being dispensed, and dispensing said object.

The invention also provides a filter rod maker comprising the feed mechanism. The filter rod maker may be configured to receive objects from the feed mechanism and to manufacture filter rods, each rod having one or more of said objects therein.

Preferably, the filter rod maker comprises a garniture configured to receive filter plug material and filter wrapping material and to form a wrapped elongate filter rod. Preferably, the garniture comprises a tongue. Preferably, the maker comprises a cutter configured to cut the elongate filter rod, thereby forming filter rod segments, each segment having one or more objects therein. The second rotary member may be arranged to deliver objects directly into the tongue such that objects are inserted into filter plug material passing through the tongue. Preferably, the second rotary member penetrates into the tongue such that each object received by the second rotary member exits the object-transport member at an exit point inside the tongue.

Preferably, the objects are breakable flavourant-containing capsules.

As used herein, the terms "flavour" and "flavourant" refer to materials which, where local regulations permit, may be used to create a desired taste or aroma in a product. They may include extracts e.g., licorice, hydrangea, Japanese white bark magnolia leaf, chamomile, fenugreek, clove, menthol, Japanese mint, aniseed, cinnamon, herb, wintergreen, cherry, berry, peach, apple, Dramboui, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Menth a), flavour masking agents, bitterness receptor site blockers, receptor site enhancers, sweeteners e.g., sucralose, acesulfame potassium, aspartame, saccharine, cyclamates, lactose, sucrose, glucose, fructose, sorbitol, or mannitol, and other additives such as chlorophyll, minerals, botanicals, or breath freshening agents. They may be imitation, synthetic or natural ingredients or blends thereof.

The invention also provides a filter rod maker comprising a garniture region having an inlet tow guide and a stuffer jet, wherein the outlet of the stuffer jet is separated from the input of the inlet tow guide by a gap. Preferably, the inlet tow guide is an inlet portion of the garniture tongue. Preferably, the gap is a free-space gap. Further preferably, the gap is approximately 10 mm.

The invention also provides a machine for making filter rods for use in the manufacture of smoking articles, comprising a tongue having first and second parts, and a rotatable object-transport member, wherein the filter rod maker has: a first body part comprising said first tongue part; a second body part comprising said object-transport member and said second tongue part; and a hinge arranged so that the relative position of the first and second body parts can be adjusted between a first position in which the first and second tongue parts are separated so that the interior of the tongue is accessible for cleaning and tow threading and a second position in which the first and second tongue parts are aligned so that tow can pass from one to the other. Preferably, the first body part further comprises a stuffer jet. Preferably, the first body part further comprises a centrifugal feed mechanism.

In order that the invention may be more fully understood, embodiments thereof will now be described by way of example only, with reference to the accompanying figures, in which;

FIG. 1 shows a feed mechanism;

FIG. 2*a* is a perspective view of the disk assembly of the feed mechanism;

FIG. 2*b* is a cross sectional view of the disk assembly of the feed mechanism;

Figure 1:
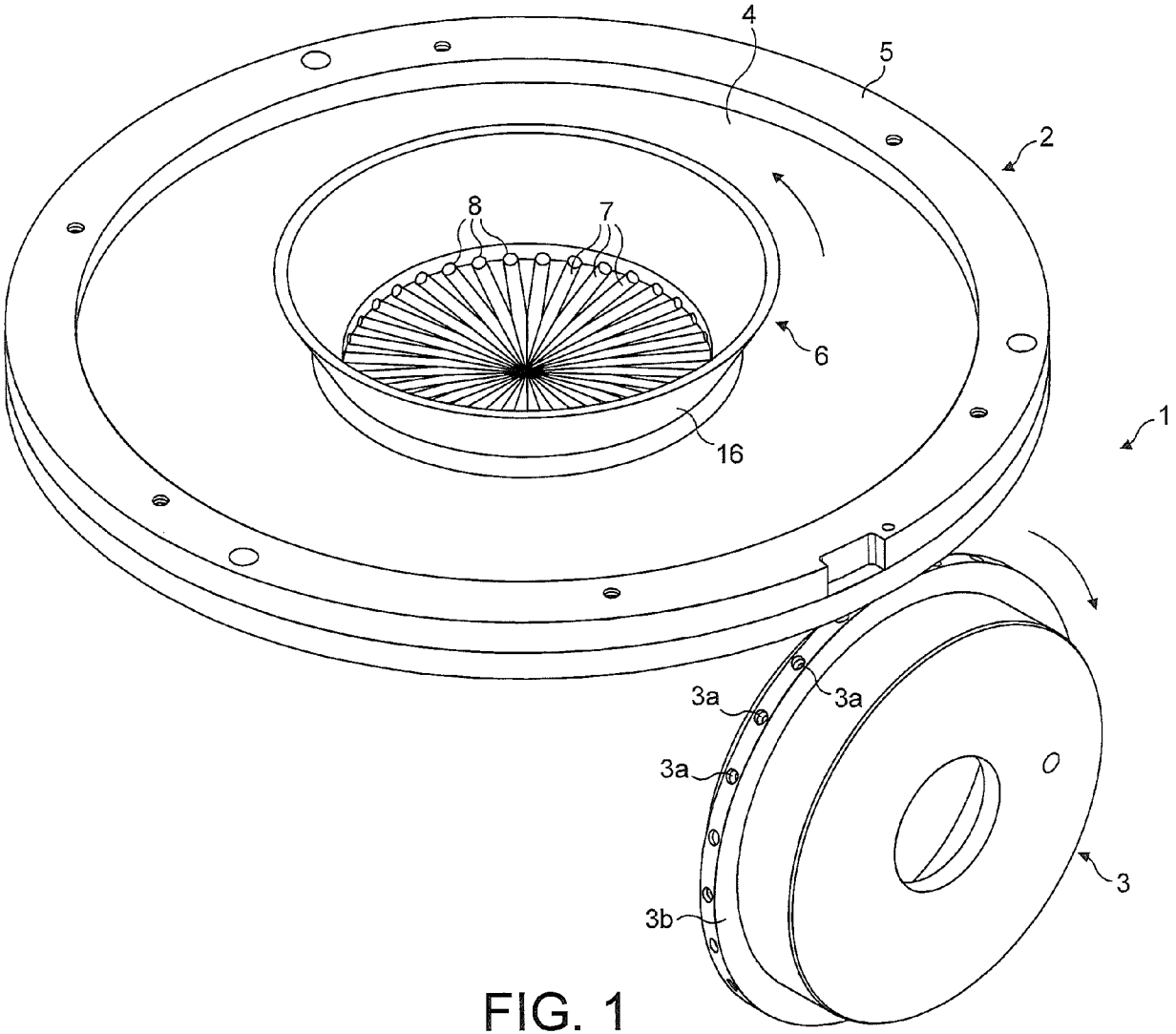

FIG. 1 shows a capsule feed mechanism 1. As shown, the feed mechanism 1 comprises a horizontally oriented disk assembly 2 and a vertically oriented rotary delivery wheel 3.

Figure 2A:
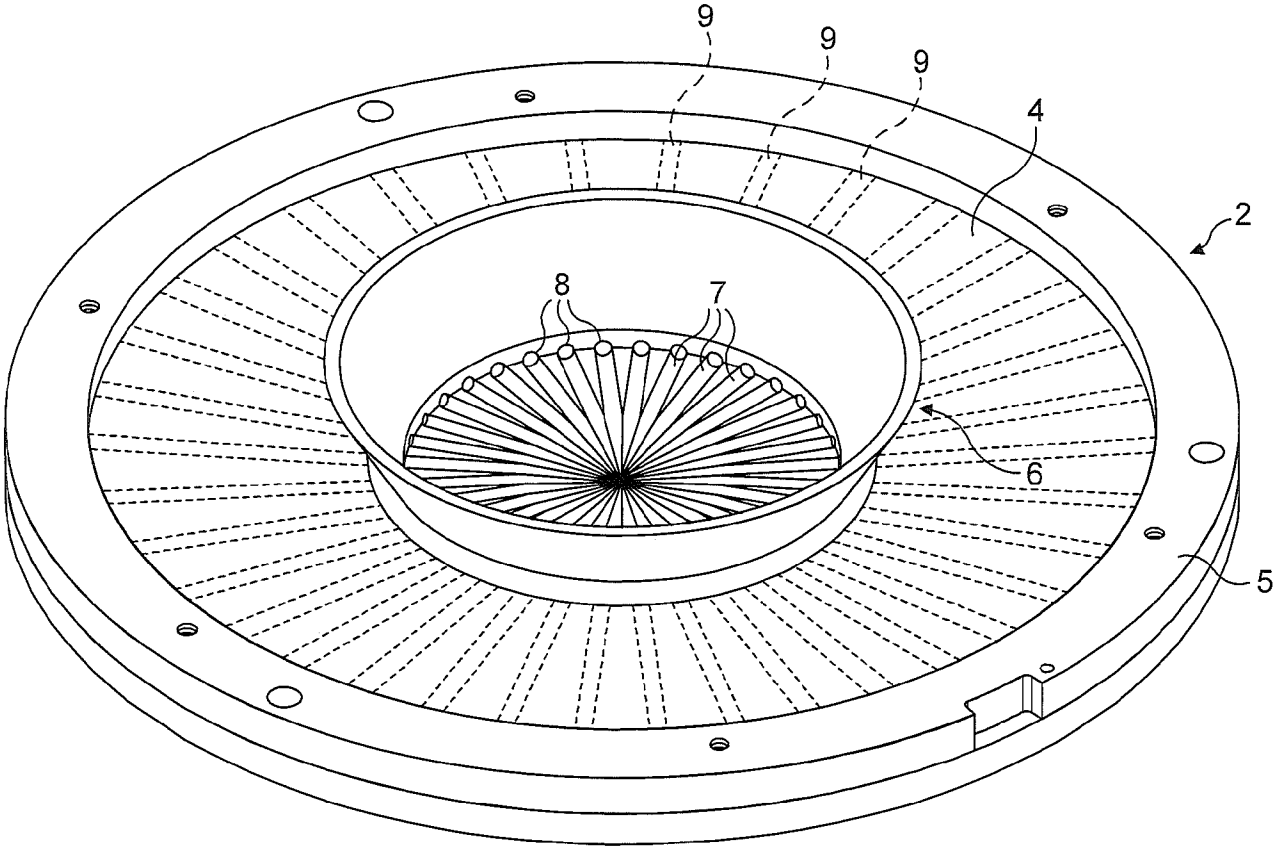
Figure 2B:
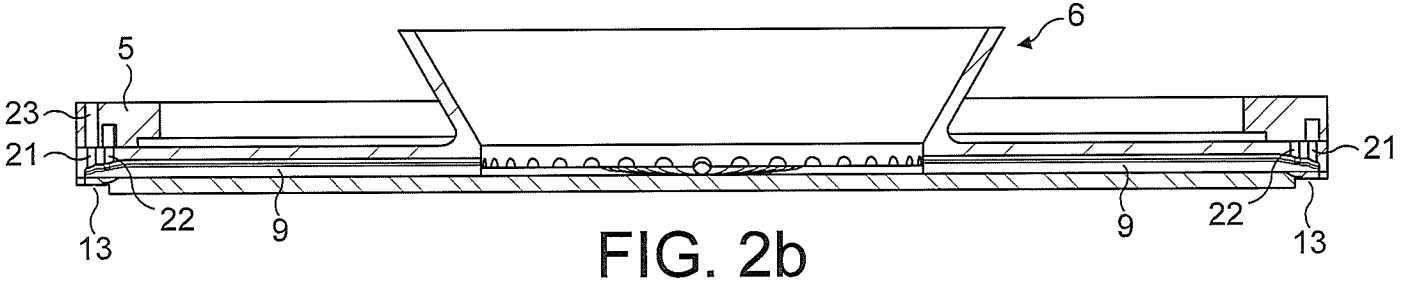

FIG. 2*a* shows the disk assembly 2 in isolation. As shown, the disk assembly 2 comprises a rotary feed disk 4 and a suction mechanism in the form of a suction ring 5. The feed disk 4 is configured to rotate about a vertical axis relative to the stationary suction ring 5. The disk 4 has a centrally positioned capsule input member 6 for receiving breakable capsules. A plurality of radially-extending capsule-receiving inlet grooves 7 are formed at the base of the input member 6. Each inlet groove 7 leads directly to an entrance 8 of one of a plurality of enclosed channels 9 which each extend radially through the inside of the feed disk 4. The channels 9 are indicated in FIG. 2*a* using dotted lines and as shown are evenly spaced around the disk 4. As shown in the sectional view of FIG. 2*b*, each channel 9 has a capsule outlet 13 positioned near the outer perimeter of the disk 4, which passes through the floor of the channel 9 to allow capsules to pass from the feed disk 4 into the delivery wheel 3. As shown in FIG. 1, the delivery wheel 3 has a plurality of capsule-receiving pockets in the form of holes 3*a* which in use successively align with the capsule outlets 13 in the channels 7 as the disk 4 and wheel 3 rotate so that capsules may successively pass from the disk 4 to the wheel 3.

In use, capsules are loaded into the input member 6 as the disk 4 rotates. Capsules may be loaded from a capsule reservoir (not shown) above the disk which feeds capsules through a tube into the input member 6. A level control mechanism including a sensor may be provided to monitor the level of capsules in the input member 6. The level control mechanism may be arranged so that capsules are only loaded into the input member 6 from the capsule reservoir when the level of capsules in the input member 6 drops below a predetermined level. Alternatively, capsules could be fed into the input member 6 by other means, for example by hand.

Figure 3:
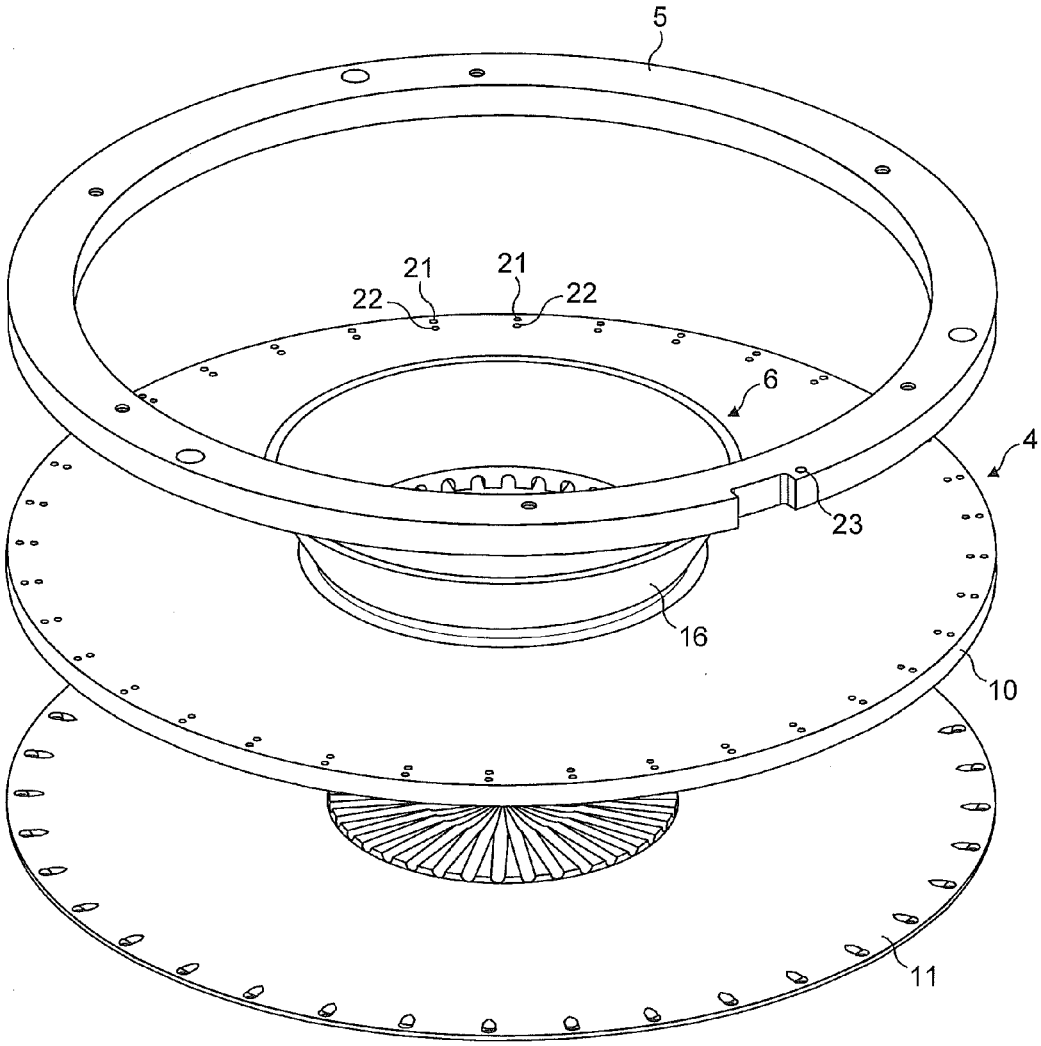
FIG. 3 is an exploded perspective view of the disk assembly.

As the disk 4 rotates, centrifugal force causes capsules received into the input member 6 to move outwardly to the entrances 8, guided in the inlet grooves 7, and then to pass through the entrances 8 and to move through the channels 9 in rows towards the outlets 13. As shown in FIG. 3, the ceiling of each channel is provided with holes 21, 22 through which suction is applied from the stationary suction ring 5 so as to control capsule movement along the channels 7 by selectively holding capsules in position. As a channel outlet 13 comes into alignment with a pocket 3*a*, the hole 21 in the ceiling of the channel 7 comes into alignment with an air ejection port 23 in the stationary suction ring 5 and a positive air flow is applied to eject the outermost capsule in the channel 7 through the outlet 13 into a pocket 3*a*.

The delivery wheel 3 is arranged to rotate and to successively deliver the capsules into a flow of tow passing through a filter maker for incorporation into filter rods. Operation of a capsule delivery wheel to bring capsules into contact with filter tow is well known per se to those skilled in the art.

Each capsule fed by the feed mechanism is preferably generally spherical, formed from gelatin and has an interior volume filled with a flavourant for example menthol, spearmint, orange oil, mint, liquorice, eucalyptus, one or more of a variety of fruit flavours or any mixture of flavourants. The capsules may have a diameter of 3.5 mm. It will be appreciated that other objects suitable for insertion into filter rods could alternatively or in addition be fed by the feed mechanism 1.

The centrifugal feed results in low impact/stress on the capsules, which allows a high speed feed without causing damage to the capsules.

Turning now to a more detailed description of the components of the disk 4, as shown in the exploded perspective view of FIG. 3, disk 4 includes an upper plate in the form of disk 10 and a lower plate in the form of disk 11. The upper and lower disks 10, 11 are fixed to one another, for example with bolts, and in use rotate together with respect to the stationary suction ring 5.

Figure 5:
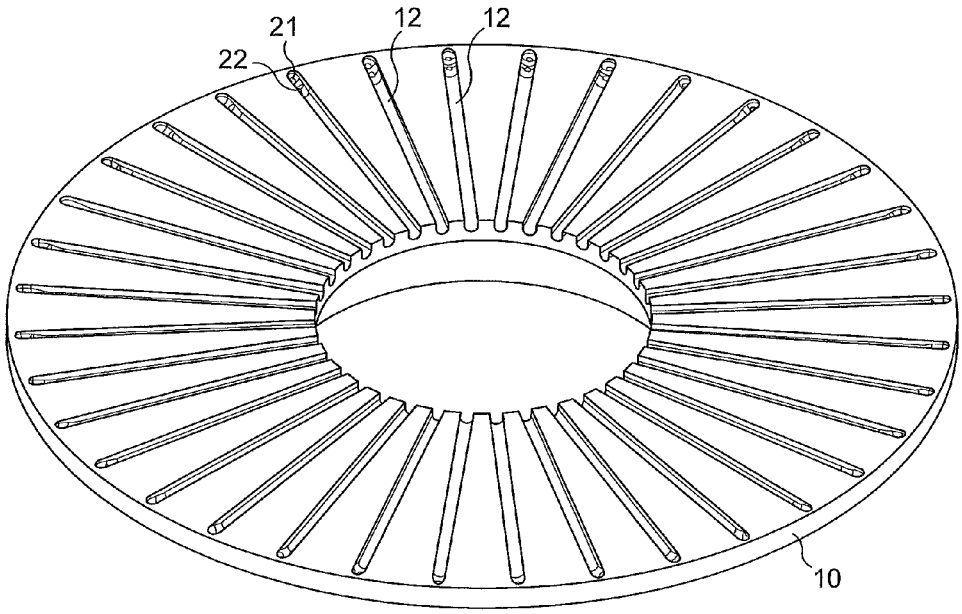
FIG. 5 is a bottom view of the upper disk of FIG. 4.
Figure 6:
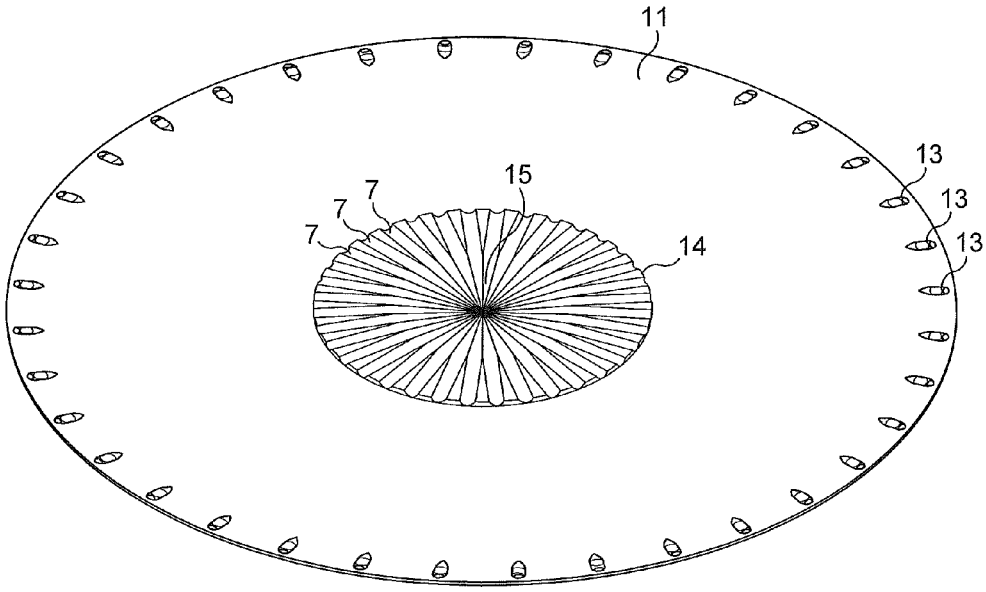
FIG. 6 is a top view of lower disk of the disk assembly.

Referring to FIG. 5, which shows an underneath view of upper disk 10, a plurality of radially extending grooves 12 having a u-shaped cross section are formed in the underside of the upper disk 10. These grooves 12 form the sidewalls and ceiling of the enclosed channels 9. The floor of each enclosed channel 9 is defined by the planar upper surface of the lower disk 11, which is shown in an upright position in FIG. 6. As shown in FIG. 6, the lower disk 11 has a plurality of holes 13 near its outer periphery, which are circumferentially spaced so that a hole is provided in the floor of each channel 9 so as to form a capsule outlet 13.

As shown in FIG. 6 the lower disk 11 includes a capsule guide in the form of raised disk 14, which forms the base of the input member 6 and acts to guide capsules from the input member 6 to the channels 9. The raised disk 14 has a smaller diameter than the lower disk 11. The raised disk 14 has a central depressed region 15 shaped to form a smooth curved surface for receiving capsules. The inlet grooves 7 extend radially outwardly from the central region 15 and in use, capsules received into the depressed region are urged by centrifugal forces towards the entrances 8 at the periphery of the disk 14, guided by the inlet grooves 7. Capsules received between the inlet grooves 7 eventually fall into the inlet grooves when a gap appears in the flow of capsules through the inlet grooves.

Figure 4:
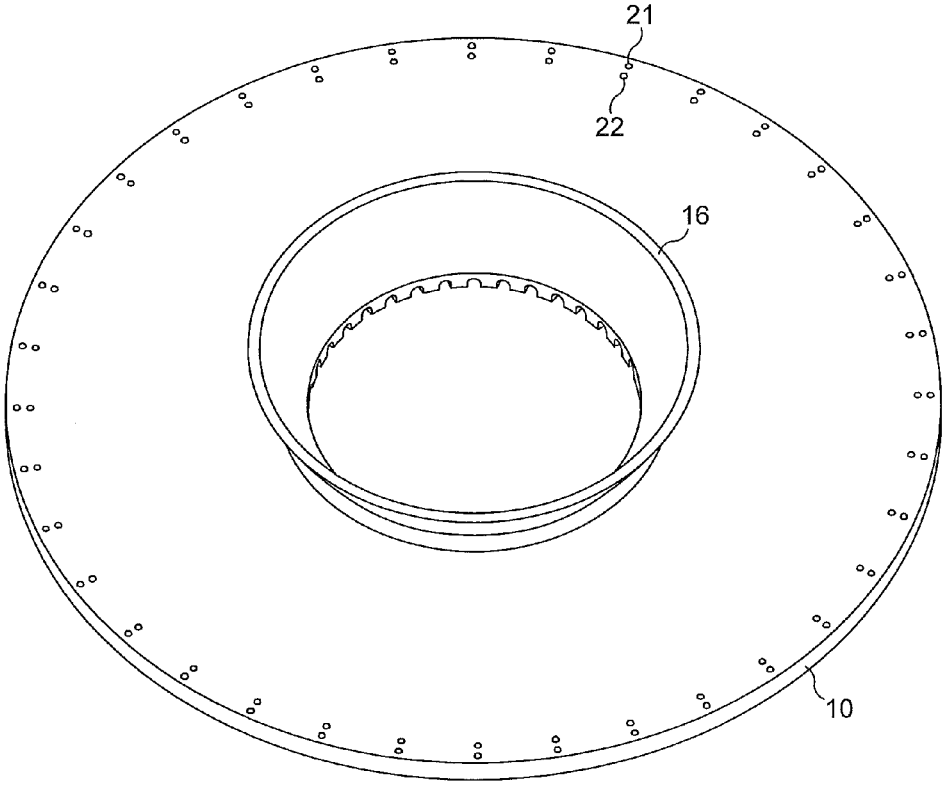
FIG. 4 is a top view of an upper disk of the disk assembly.

As shown in FIG. 3 and FIG. 4, the input member 6 further comprises a funnel 16 attached to the upper disk 10 for directing capsules to the capsule guide 14. The funnel 16 may be attached to the upper disk with bolts (not shown), or alternatively the funnel 16 and the upper disk 10 may be formed in one piece.

The entrances 8 are each dimensioned to only permit entry of a single capsule at a time and the channels 9 are dimensioned so that only a single row of capsules can move along each channel 9. Thus, once they enter the entrances 8, the capsules move along the channels 9 inside the disk 4 in single file rows until they reach the capsule outlets 13.

Figure 7:
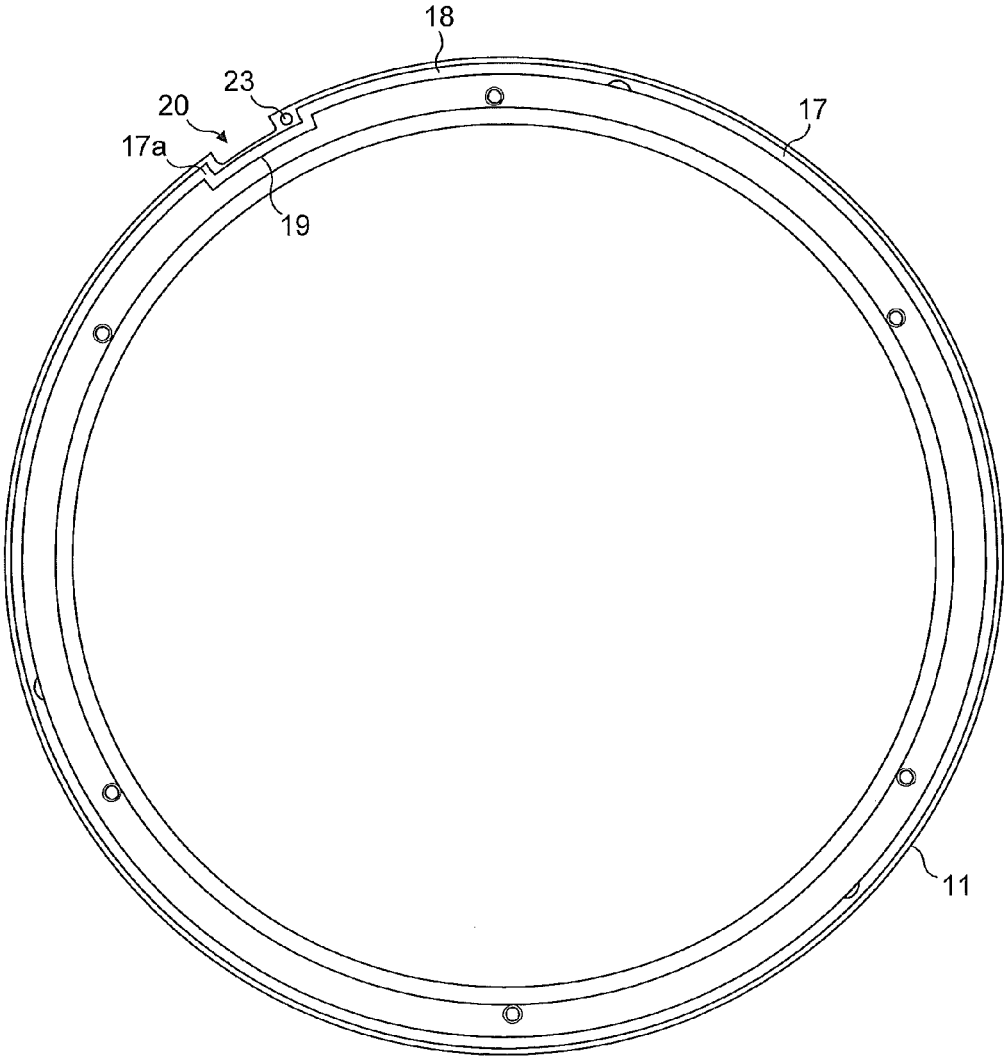
FIG. 7 is an underneath plan view of the suction ring of the disk assembly.
Figure 8:
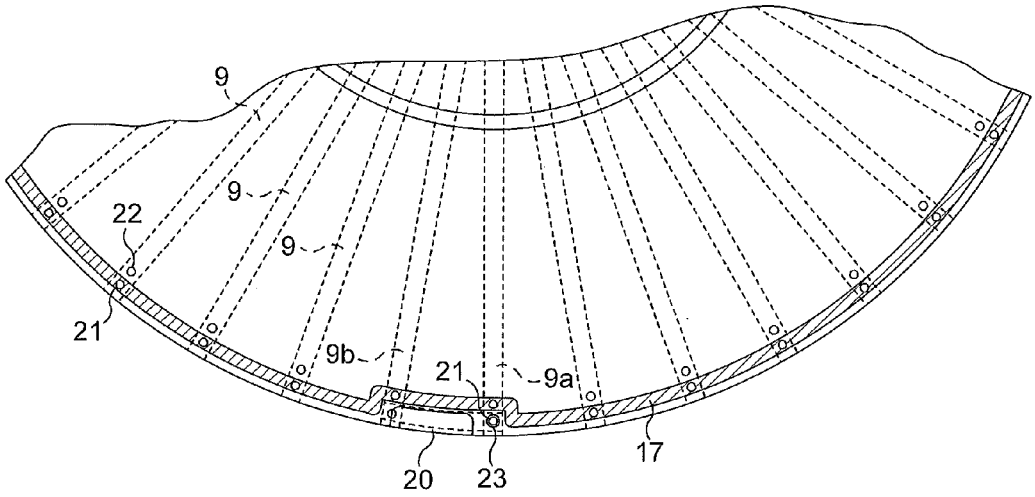
FIG. 8 is a top view illustrating the rotary feed disk of the disk assembly in a dispensing position.

FIG. 7 shows the underside of the stationary suction ring 5. In use, a vacuum pump (not shown) applies suction to a vacuum channel 17 of the suction ring 5, which thus acts as an intake region of the suction mechanism. Referring to FIG. 7, channel 17 follows a circular arc 18 of a first radius around the ring. As shown, the channel 17 deviates from the circular path 18 at point 17*a* and turns radially inwardly before turning again to form a short circular arc 19 of a second radius less than the first radius. The vacuum channel 17 then turns again back out of the circular arc 19 and into arc 18. Thus, the vacuum channel 17 comprises a first circular arc region 18 of first radius, and a second circular arc region 19 of a different radius. As shown in FIG. 7, the deviation of the channel 17 defines a gap 20 in the circular arc 18, which acts as a vacuum relief region 20 as will be described in more detail below. The vacuum relief region 20 is illustrated in FIG. 8 with dotted lines.

As shown in FIGS. 3-5, the upper disk 10 has a plurality of pairs of through-holes 21, 22 arranged for alignment with the circular arc regions 18, 19 during rotation. The through holes 21, 22 are positioned to allow suction from the vacuum channel 17 to be applied to capsules in the channels. As shown, the outer holes 21 are arranged in a circle around the face of the disk 10 and are evenly spaced from one another. The pitch circle of the outer holes 21 has a radius equal to the radius of the outer arc region 18 of the suction ring 5. The inner holes 22 are arranged in a circle of smaller radius and are also evenly spaced from one another. The pitch circle of the inner holes 22 has a radius equal to the radius of the inner arc region 19 of the suction ring 5.

As shown in FIG. 5, each pair of holes 21, 22 passes through the roof of one of the channels 9. In this way, each channel is provided with an outer through-hole 21 and an inner through-hole 22 for alignment with the arc regions 18, 19 respectively. The through-holes 21, 22 are small enough so that a capsule cannot pass through. In the case of feeding 3.5 mm diameter capsules, the inner holes 22 may be spaced from the outer holes 21 by 4 mm The outer holes 21 are positioned in the channels 9 so as to be aligned with the capsule outlets 13 in the lower disk 11. In this way, the outer holes 21 and the capsule outlets 13 are both arranged at a radial distance from the centre of the disk 4 equal to the radius of the first circular arc region 18 of the vacuum channel 17.

The disk 4 is rotatably mounted concentrically with the stationary suction ring 5. In use, the disk 4 rotates anti-clockwise (when viewed from the top). During rotation the outer hole 21 of each channel 9 rotates beneath the first arc region 18 of the stationary vacuum channel 17 so that suction is applied by the suction ring 5 through the hole 21. The outer hole 21 remains aligned with the vacuum channel 17 until the hole 21 reaches the vacuum relief region 20. At this point, the hole 21 is no longer aligned with the vacuum channel 17 so that suction is no longer applied through the hole 21.

During rotation the outermost capsule in each channel 9 is held above the capsule outlet 13 by suction applied through the hole 21, prior to being dispensed. The channel and outlet 13 are sized to prevent other capsules from moving outwardly past the outermost capsule and passing out of the outlet 13. Thus, a single-file row of capsules forms in each channel 8.

The vacuum is broken on the outermost capsule when the hole 21 of the channel 9*a* reaches the vacuum relief region so that the capsule can be ejected through the capsule outlet 13.

As shown in FIGS. 7 and 8, the suction ring 5 includes an ejection port 23 positioned in the vacuum relief region 20, for applying a compressed air jet to eject capsules from the channels 8. The ejection port 23 is positioned at the same radial displacement as the outer holes 21 of the upper disk 10 so that the outer hole 21 of a channel 9*a* comes into register with the ejection port 23 as the channel 9*a* moves into the position of FIG. 8. When the channel 9*a* reaches the dispensing position of FIG. 8, an air jet is applied from the ejection port 23, through the outer hole 21, to blow the outermost capsule in the channel 9*a* into a pocket 3*a* of the delivery wheel 3.

As shown, the ejection port 23 is located in the vacuum relief region 20 at a position such that the vacuum is broken just before the capsule is ejected. The speed of rotation of the disk 4 is sufficiently fast so that the capsule does not fall fully through the outlet 13 in the brief free-fall period after vacuum release and before ejection.

The next channel 9*b* then moves into the dispensing position and at the same time the wheel 3 rotates clockwise so that the next pocket 3*a* is positioned above the next outlet 13 so that the outermost capsule in the channel 9*b* can be dispensed. A synchronisation mechanism is provided to synchronise the rotation speed of the disk 4 and wheel 3 to ensure delivery from successive channels 9 into successive pockets 3*a* of the wheel 3. Thus, continued rotation of the feed disk 4 and wheel 3 causes the outermost capsule in each successive channel 9 to be successively dispensed into the wheel 3.

After the outermost capsule in a channel 9 is dispensed into the wheel 3, the channel 9 rotates out of the vacuum relief region 20, and centrifugal force causes the row of capsule in the channel 9 to move outwardly until the new outermost capsule reaches the hole 21, at which point it is held in place above the outlet 13 by suction applied through the hole 21. Continued rotation of the disk 4 subsequently returns the channel 9 to the vacuum relief region 20, where the outermost capsule is dispensed, and so the cycle repeats.

The synchronisation mechanism ensures that the circumferential velocity of the wheel 3 and disk 4 are the same so there is no impact force on the capsule in the tangential direction during transfer from the wheel 3 to the disk 4. This in turn reduces the risk of cracked capsules in the eventual filter rod.

A single synchronous motor may be used to synchronously drive the disk 4 and wheel 3 through a gearbox. A gearbox having bevel gears with a 2:1 ratio is suitable. Alternatively, synchronous motors and encoders could be used to synchronise rotation as required. Belt drives may be used to drive the disk 4 and wheel 3.

The wheel 3 is provided with a suction housing arranged to assist transfer of the capsules from the channels 9 of the disk 4 into the holes 3*a*, and to maintain the capsules in position in the holes 3*a* under they are ejected into the tow. The housing is adapted so that suction starts 10 degrees before the 12 o'clock position of the wheel. The wheel 3 also includes an ejection port for delivering a jet of air to eject capsules from the wheel 3 into the filter tow. The holes 3*a* have a depth of approximately half of the diameter of a capsule so that the capsules sit in the pockets 3*a* on the circumference of the wheel 3 until ejection. This ensures that the transfer distance from the disk 4 to the wheel 3 is kept to a minimum, which allows increased speed. Instead of, or in addition to a suction housing, a stationary guide may be positioned around the periphery of the wheel to prevent capsules from falling out.

Turning now to a description of the inner through-holes 22, these holes are positioned at a radial distance from the centre of the disk equal to the radius of the second (inner) arc region 19 of the vacuum channel. As a result, as shown in FIG. 8, the inner hole 22 of a channel 9 comes into register with the second arc region 19 when the hole 21 of channel 9 is aligned with the vacuum relief region 20. The inner holes 22 are spaced from the outer holes 21 so that when a channel 9 is aligned with the vacuum relief region, vacuum is applied to the second outermost capsule in the row to hold it in place as the outermost capsule is being dispensed. The channels 9 are sized so that the held capsule prevents other capsules from passing outwardly through the capsule outlet 13. In this way outward movement in a row is restricted when a capsule is being dispensed. This ensures that only a single capsule is dispensed through the outlet 13 at a time.

As the channel 9*a* rotates beyond the vacuum relief region 20, inner hole 22 comes out of register with vacuum channel 17 and suction through the inner hole 2 is stopped, so that centrifugal force causes the other capsules in the row to move outwardly towards the capsule outlet 13, until the outermost capsule in the channel 9*a* moves into position above the capsule outlet 13, where it is held in place by suction applied through the hole 21.

Figure 9:
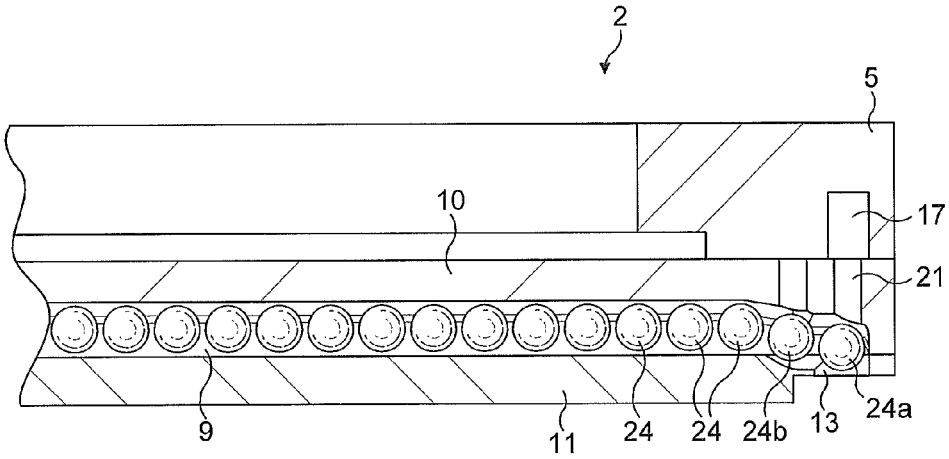
FIG. 9 is a cross sectional view of the disk assembly showing a channel in a "dwell position", in which vacuum is applied to the last capsule in the channel.
Figure 10:
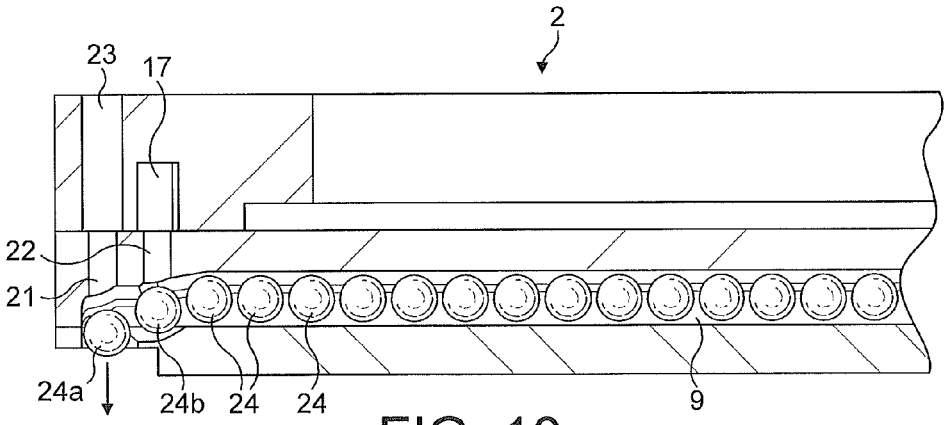
FIG. 10 is a cross sectional view of the disk assembly showing a channel in a dispensing position, in which vacuum is applied to the second last capsule in the channel.
Figure 11:
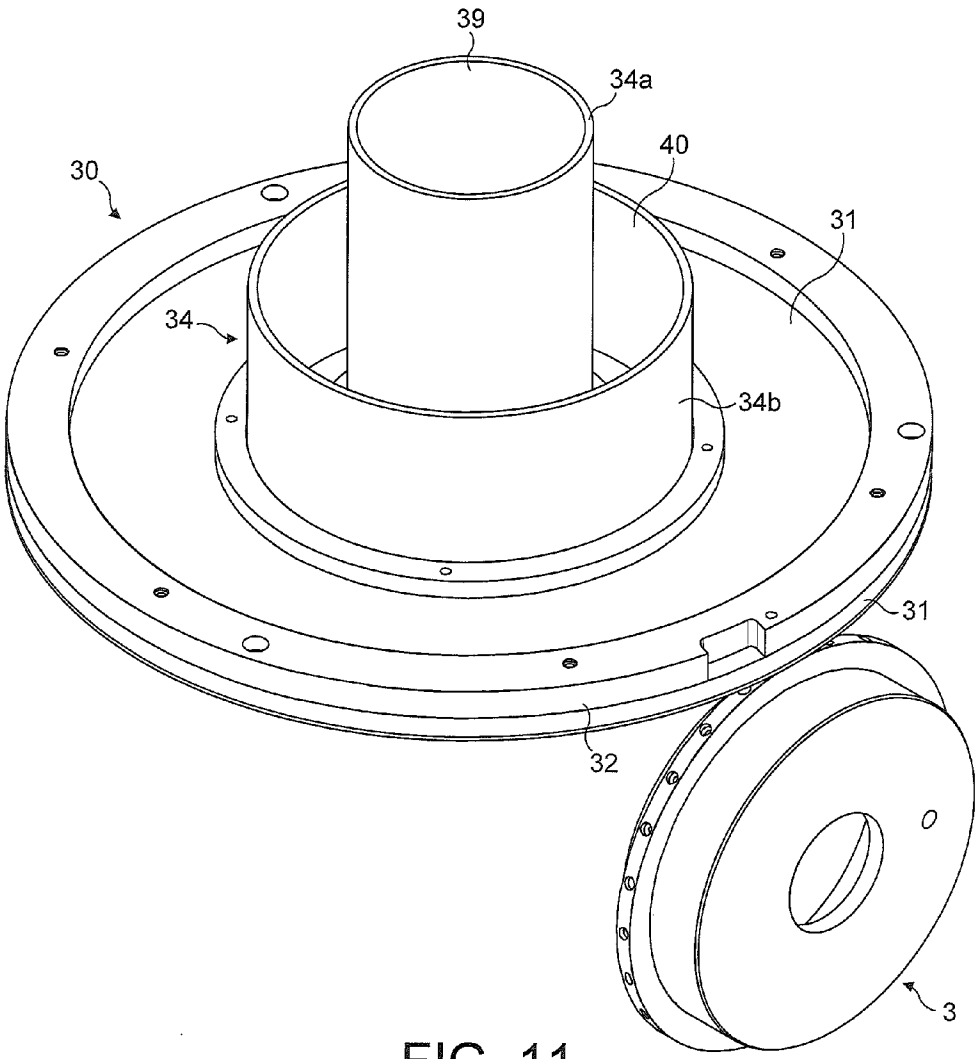
FIG. 11 shows another capsule feed mechanism.

FIGS. 9 and 10 show cross sectional views of the disk assembly 2 in different rotational positions FIG. 9 shows a channel 9 in the "dwell" position, in which vacuum is applied to the outermost capsule 24*a* in the row of capsules 24 in the channel 9. As shown, in this position the outer hole 21 is aligned with the vacuum channel 17 so as to hold the outermost capsule 24*a* in place. FIG. 10 shows a channel 9 in the dispensing position. As shown outer hole 21 is aligned with the ejection port 23 and inner hole 22 is aligned with the vacuum channel 17 so as to hold the penultimate capsule 24*b* in position, and thus prevent the capsule 24*b* and the other capsules 24 in the row from being dispensed.

As illustrated in FIGS. 9 and 10, the outlets 13 in the lower disk 11 and the grooves 12 in the upper disk 10 are shaped so that the outermost capsule 24*a* in the channel 9 is positioned lower in the channel 9 than the second outermost capsule 24*b*. This helps prevent capsules from wedging at the end of the channel 9, and also brings the outermost capsule 24 closer to the wheel 3 to reduce the distance that the capsule has to travel on transfer to the wheel 3.

Figure 12:
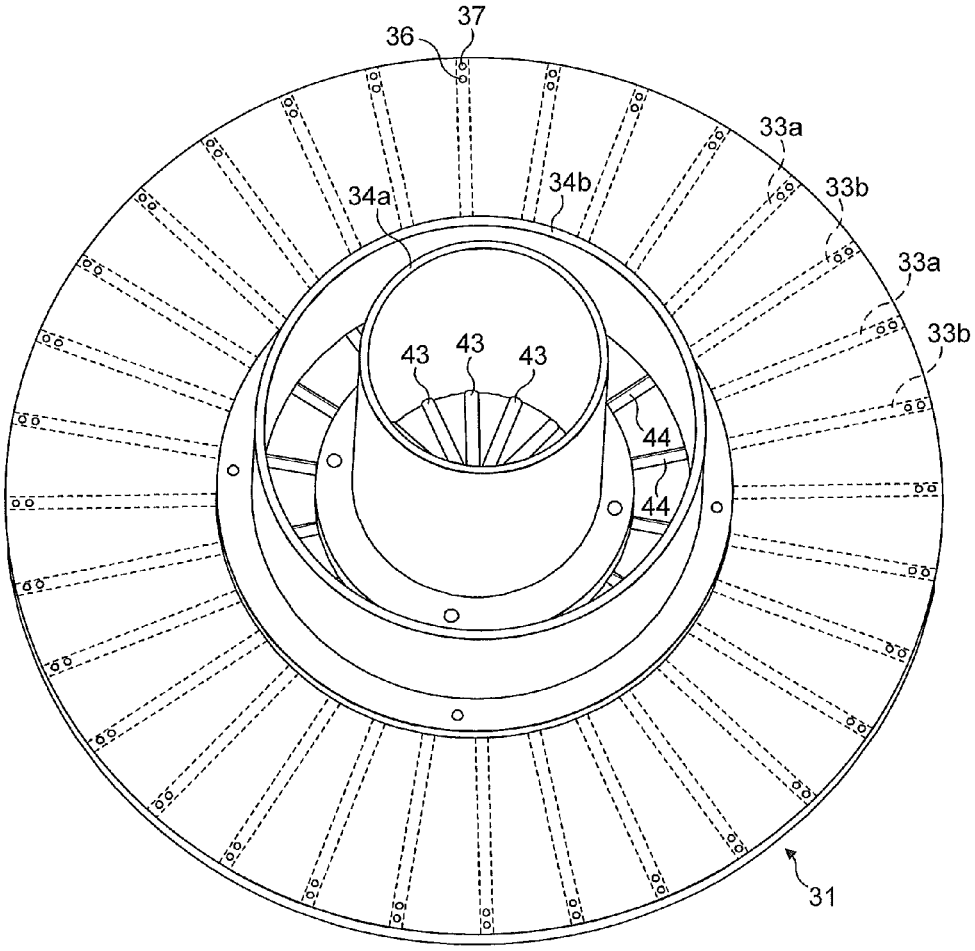
FIG. 12 is a top view of the rotary feed disk of the feed mechanism of FIG. 11.
Figure 13:
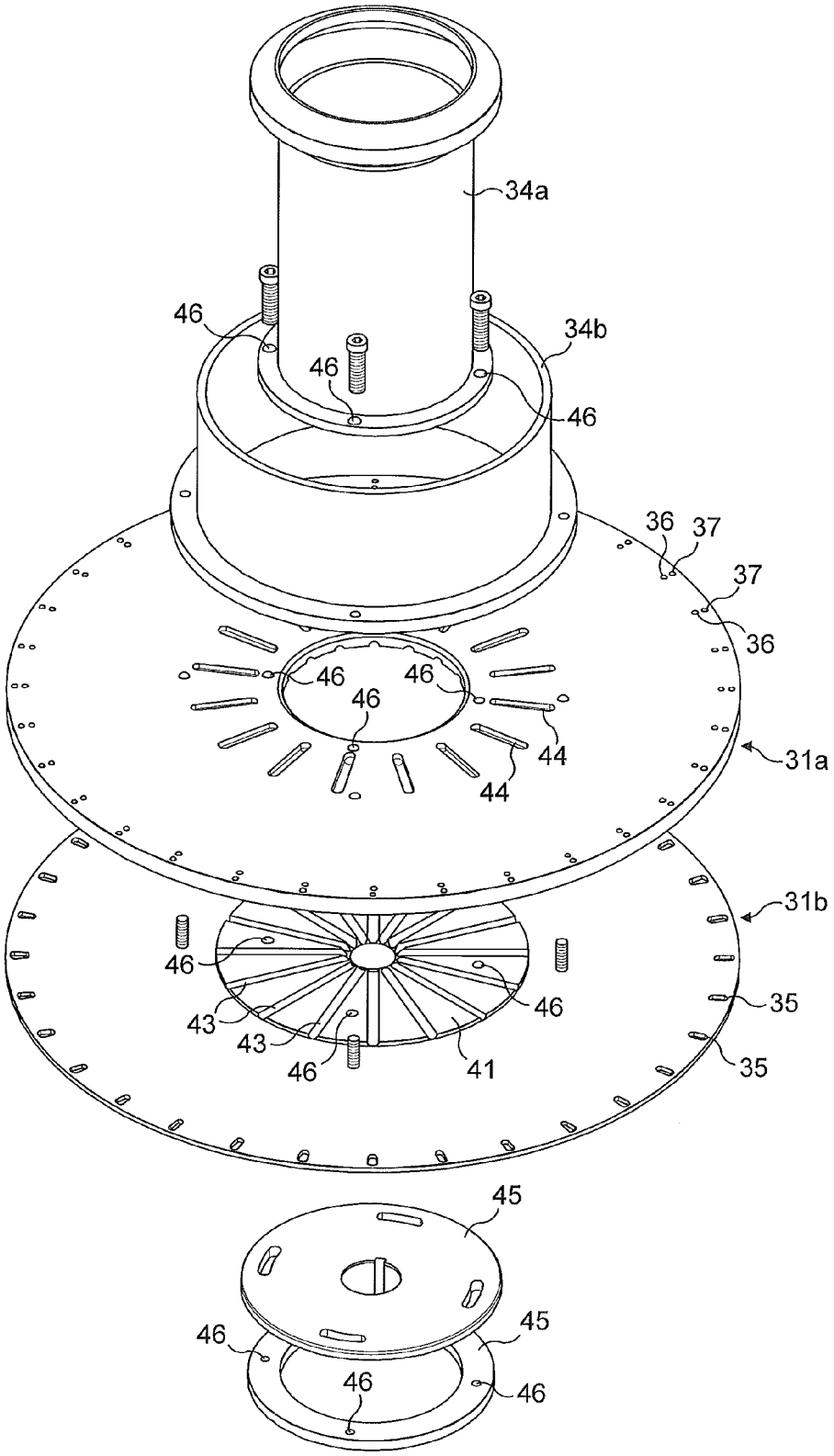
FIG. 13 is exploded perspective view of the rotary feed disk of FIG. 12.

FIG. 11-20 illustrate another feed mechanism 30. As shown, like the feed mechanism 1 of FIG. 1, feed mechanism 30 has a disk assembly comprising a rotary feed disk 31 which rotates relative to a fixed suction ring 32. The rotary feed disk 31 also has a plurality of internal radially extending channels 33*a*, 33*b*, which receive capsules from a capsule input member 34 and which guide the capsules to capsule outlets 35 in the floor of the channels 33*a*, 33*b* near the outer perimeter of the disk. As shown in FIG. 12, each channel 33*a*, 33*b* is provided with a pair of through-holes 36, 37, which are positioned in the same way as in the disk 10 of the feed mechanism 1 of FIG. 1. The suction ring 32 is the same as the suction ring 5 of FIG. 7 and has the same purpose, ie to hold the outermost capsule in a channel 33*a*, 33*b* via the outer through-hole 37 until it is dispensed, and to hold the second outermost capsule in place via inner through-hole 36 when the outermost capsule is being dispensed. The suction ring 32 also has an ejection port to eject a capsule from the feed disk 31 when a channel 33*a*, 33*b* is in the dispensing position. Like feed disk 4, feed disk 31 is formed from an upper disk 31*a* and a lower disk 31*b* which are fixed to one another. The channels 33*a*, 33*b* are defined by radial grooves 38*a*, 38*b* in the underneath surface of the upper disk, shown in FIG. 14. As with the feed disk 4 of FIG. 2, the upper surface of the lower disk 31*b* defines the floor of the channels 33*a*, 33*b*. As shown in FIG. 13, each channel 32*a*, 33*b* is provided with a capsule outlet 35 positioned near the outer perimeter of the feed disk 31, which passes through the floor of the channel 33*a*, 33*b* to allow capsules to pass from the feed disk 31 into the delivery wheel 3.

Figure 30:
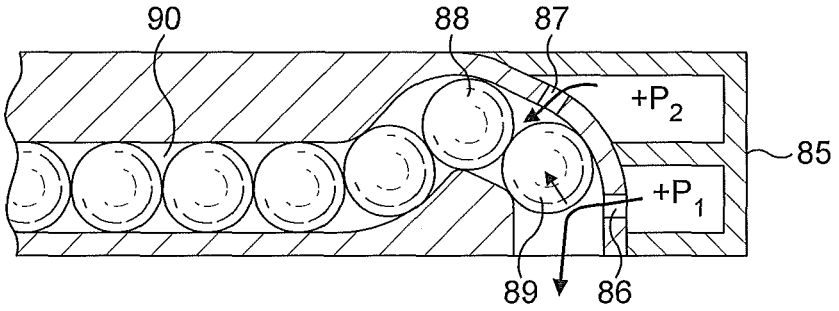
FIG. 30 illustrates an alternative pneumatic mechanism for holding capsules in the channels by positive pressure.

The differences between the feed mechanism 30 of FIG. 30 and the feed mechanism 1 of FIG. 1 lie in the structure of the capsule input member 34 and the channels 33*a*, 33*b*.

Figure 14:
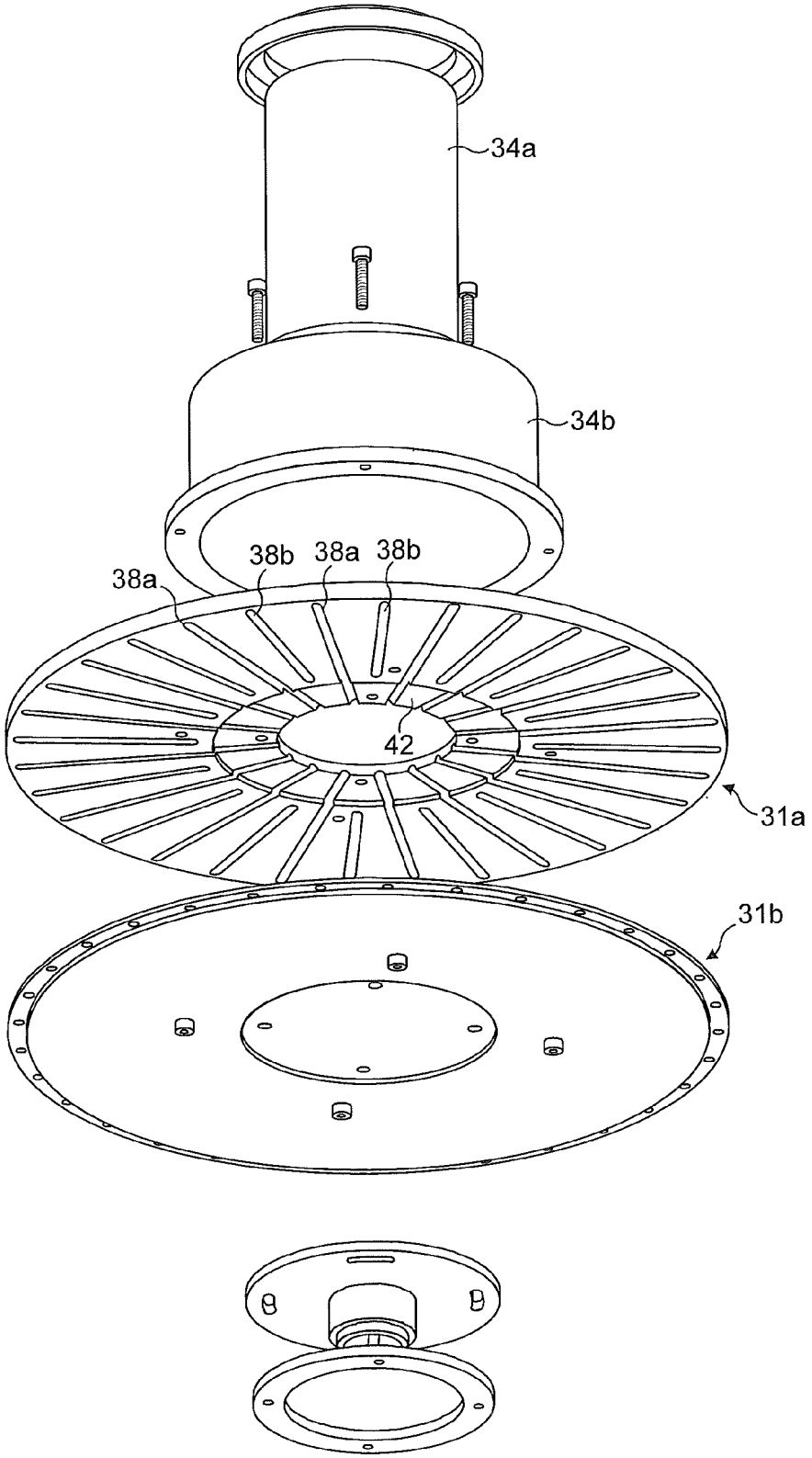
FIG. 14 is an exploded view of the rotary feed disk of the feed mechanism of FIG. 11, showing the bottom surfaces of the upper and lower disks.
Figure 15:
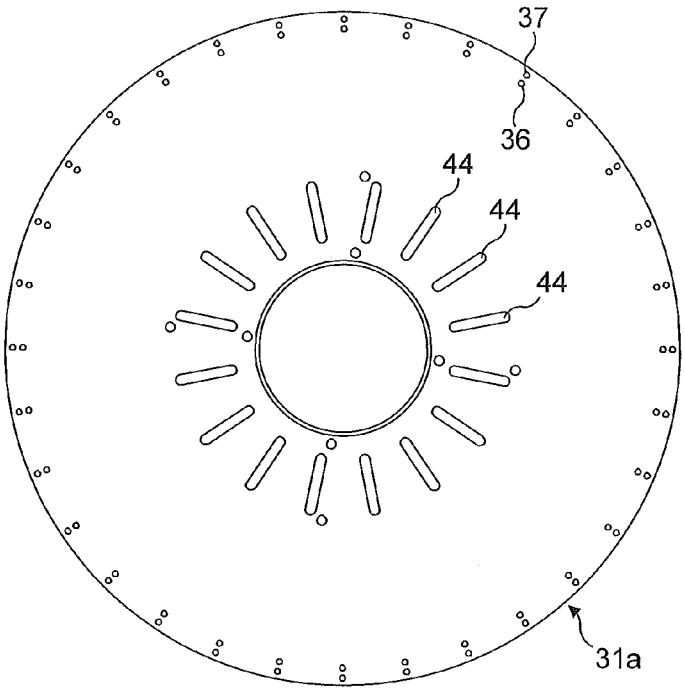
FIG. 15 is a top view of the upper disk of the feed mechanism of FIG. 11.

As shown, the capsule input member 34 comprises two concentric tubes 34*a*, 34*b*, which extend out of the plane of the feed disk 31. The inner tube 34*a* defines a first capsule input 39. The gap between the inner tube 34*a* and the outer tube 34*b* defines a second capsule input 40. As illustrated in FIGS. 13 and 14, the inner tube 34*a*, outer tube 34*b*, upper disk 31*a* and lower disk 31*b* are fixed together, and to flanges 45, by way of bolt holes 46.

Figure 20:
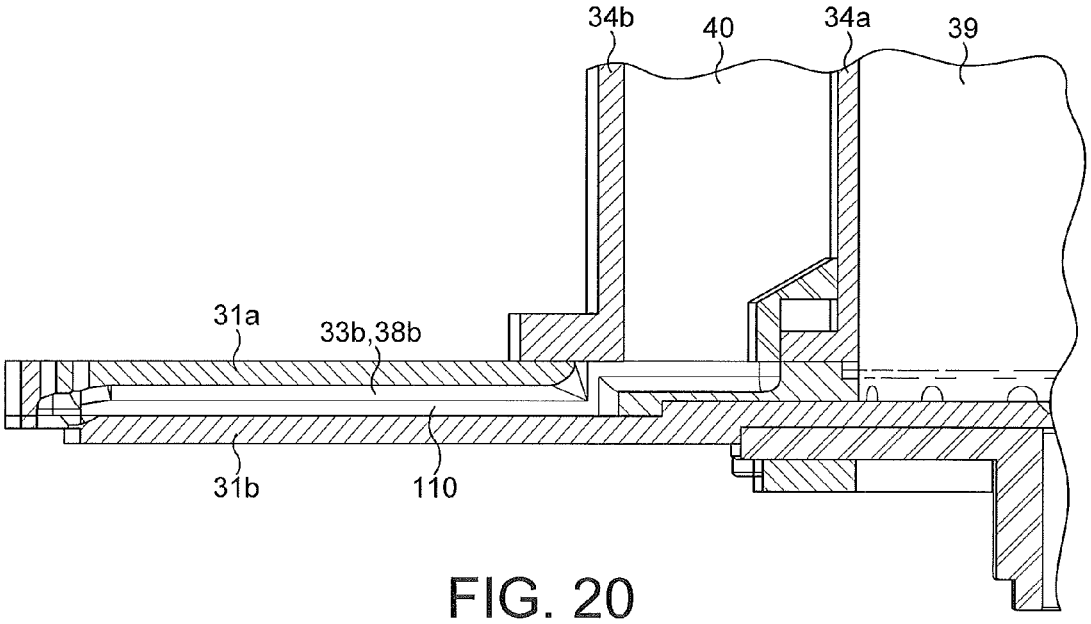
FIG. 20 is a sectional view showing the capsule path for capsules received at a second input.

Referring to FIG. 12, the disk 31 has two sets of channels 33*a*, 33*b* for guiding capsules respectively received into the first and second capsule inputs 39, 40. The channels 33*a*, 33*b* pass through the inside of the disk 31 and are indicated using dotted lines in FIG. 12. The first and second sets of channels 33*a*, 33*b* are respectively defined by first and second sets of grooves 38*a*, 38*b* formed in the underside of the disk 31*a*. The channels 33*a*, 33*b* of the first and second sets are alternately positioned around the disk 31. The first set of grooves 38*a* extend from the first capsule input 39, while the second set of grooves 38*b* extend from the second capsule input 40. As shown in FIG. 20, the second set of grooves 38*b* stop in the gap between the inner input tube 34*a* and the outer input tube 34*b*.

As shown in FIG. 13, the lower disk 31*b* has a raised disk 41, which is similar to the raised disk 14 of FIG. 6. Referring to FIG. 14, the upper disk 31*a* has a recessed region 42 shaped to accommodate the raised disk 41 so that the upper and lower disks 31*a*, 31*b* fit flush together. However, unlike the raised disk 14, the inlet grooves 43 of the raised disk 41 do not lead to every channel of the upper disk 31*a*, but instead only lead to every other channel 33*a* in the upper disk 31*a*. That is, the inlet grooves 43 are aligned with the first set of channels 33*a* and not with the second set of channels 33*b*. Capsule passage from the inlet grooves 43 to the second set of channels 33*b* is blocked by the interior walls of the rotary disk 31.

Thus, capsules received in the first input 39 are guided by the inlet grooves 43 to the first set of channels 33*a*. In this way, capsules received in the first input 39 pass exclusively into the first set of channels 33*a*.

As shown in FIG. 13, the shorter channels 33*b* have elongate inlets 44 formed in the top surface of the upper disk 31*a*. These inlets 44 are positioned between the inner input tube 34*a* and the outer input tube 34*b* so that capsules can pass from the second capsule input 40 through the inlets 44 and into the second set of channels 33*b*. The shorter channels 33*b* therefore start outside the inner input tube 34*a* and then pass below the outer input tube 34*b*, where they drop down to the surface of the lower disk 31*b*, as shown in FIG. 20. In use, capsules received into the second capsule input 40 fall under gravity into the inlets 44 and are moved by centrifugal force into and through the channels 33*b* to the channel outlets.

In this way, capsules received in the second input 40 pass exclusively into the second set of channels 33*b*.

Figure 19:
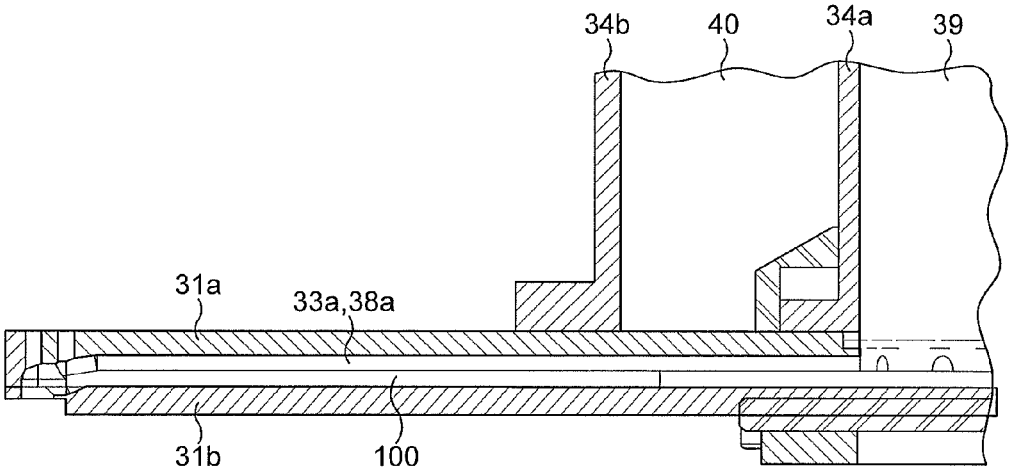
FIG. 19 is sectional view showing the capsule path for capsules of received at a first input.

FIG. 19 is a cross sectional view of the rotary disk 31 with respect to a plane normal to the longitudinal axis of one of the channels 33*a* of the first set. FIG. 19 illustrates the capsule path 100 from the first capsule input 39 through the channel 33*a*.

FIG. 20 is a cross sectional view of the rotary disk 31 with respect to a plane normal to the longitudinal axis of one of the channels 33*b* of the second set. FIG. 20 illustrates the capsule path 110 from the second capsule input 40 through the channel 33*b*.

Thus, the first set of channels 33*a* are loaded with capsules from the first input and the second set of channels 33*b* are loaded with capsules from the second input. Transfer to the delivery wheel 3 then proceeds as described above in relation to the feed mechanism 1 of FIG. 1, ie: the outermost capsule in each channel is held by suction applied by suction ring 32 until the channel reaches the vacuum relief region, where the vacuum switches to a positive air supply which ejects the capsule into the delivery wheel 3. Since the channel groups 33*a*, 33*b* are arranged alternately, capsules from the first and second inputs are alternately delivered into the pockets of the delivery wheel and thus alternately delivered into the tow.

It will be appreciated that the channel groups 33*a*, 33*b* need not be arranged alternately, and could be arranged in any order so as to provide a desired transfer sequence into the delivery wheel and thus into the tow. For example, the channel groups 33*a*, 33*b* could be arranged so that two capsules from the first input are successively delivered into the wheel 3, followed by a pair of capsules from the second input, followed by a pair of capsules from the first input and so on.

The capsule inputs 39, 40 may be loaded with capsules of the same type or alternatively with capsules of different types. For example, the capsule inputs 39, 40 may be respectively loaded with capsules having different flavours. In this way, capsules of different types can be delivered into the tow in any desired sequence determined in accordance with the arrangement of the channel groups 33*a*, 33*b*.

Figure 16:
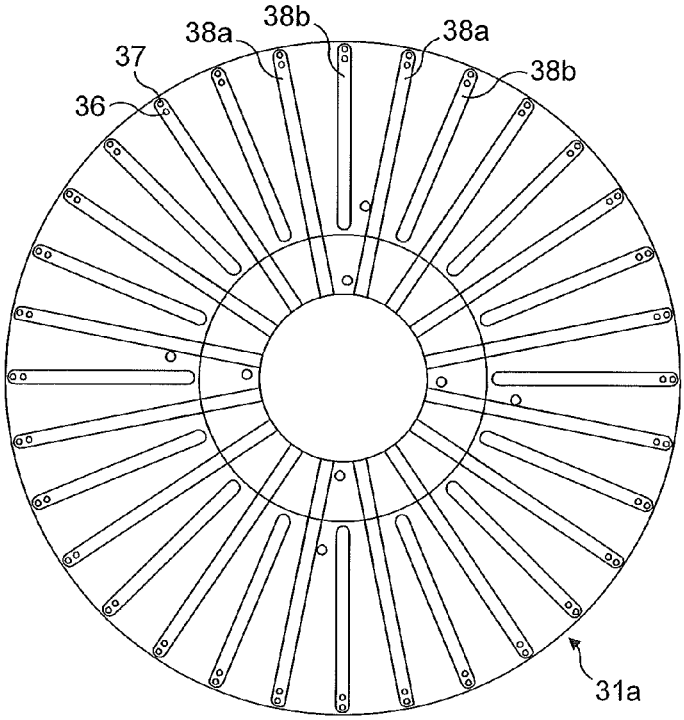
FIG. 16 is a bottom view of the upper disk of the feed mechanism of FIG. 11.
Figure 17:
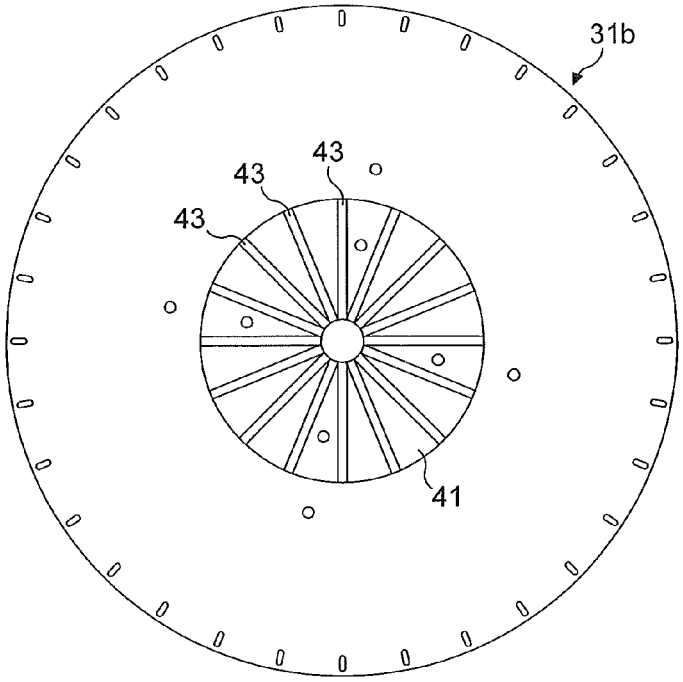
FIG. 17 is a top view of the lower disk of the feed mechanism of FIG. 11
Figure 18:
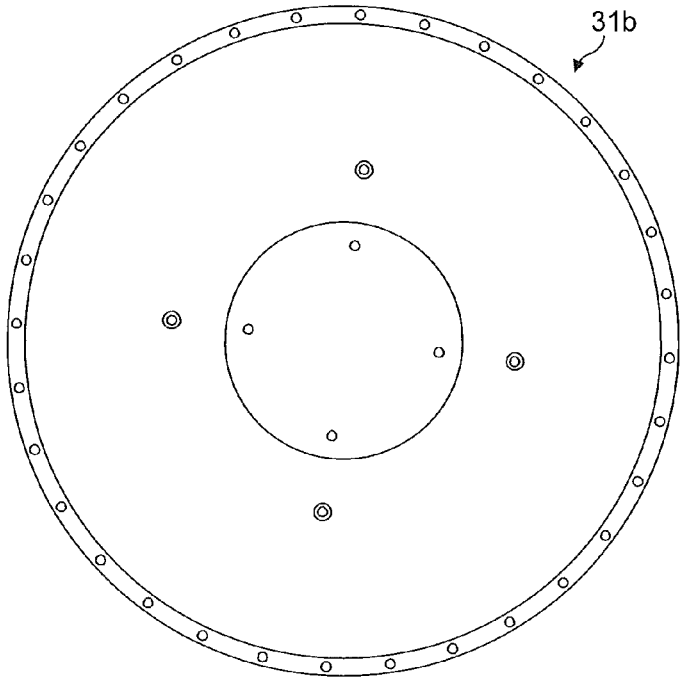
FIG. 18 is a bottom view of the lower disk of the feed mechanism of FIG. 11

Furthermore, although the channels 38*a*, 38*b* of the disk 31*a* of FIG. 16 are evenly spaced around the disk, this is not essential. Alternatively for example, the channels 33*a*, 33*b* may be arranged in pairs, wherein the angular separation between neighbouring channels in a pair is less than the angular separation between neighbouring channels in adjacent pairs. The pockets 3*a* of the delivery wheel may then be spaced in a corresponding manner to the channel spacing, ie: in corresponding spaced pairs, so that capsules are successively delivered from successive channels of the disk 4 into successive pockets of the wheel 3. Thus, capsules may be delivered from the delivery wheel 3 into the tow with varying intervals between successive deliveries, so that any desired longitudinal arrangement of capsules can be obtained in the eventual filter rods.

Figure 28:
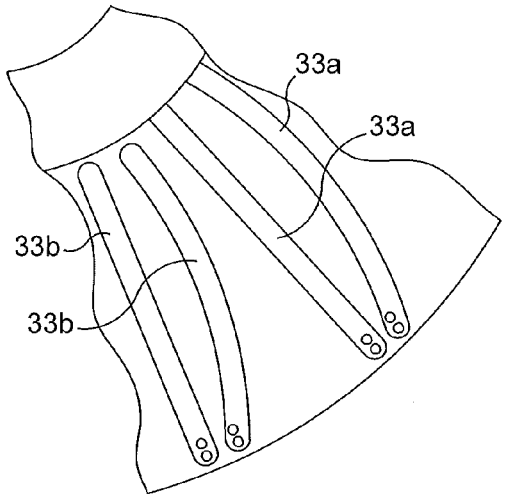
FIG. 28 shows a bottom view of another upper disk.

In some examples, the channels may deviate from a radial path. The channels may be curved. FIG. 28 illustrates the upper disk of an alternative rotary member which has curved channels 33*a*, 33*b*. In the corresponding lower disk (not shown), the outlets are arranged in register with the end of the corresponding grooves.

As shown, in the disk of FIG. 28 the channels 33*a*, 33*b* are arranged in pairs, each pair including a curved channel. The channels are curved so that the channel outlets of channels in a pair are provided close to one another. The relatively wide angular gap between the channel inlets prevents capsules from jamming on entry into the channels. The relatively narrow gap between the outlets allows capsules from a pair to be delivered in close succession, resulting in a close separation, or "pitch" between these capsules when positioned in the eventual filter rod.

Figure 29:
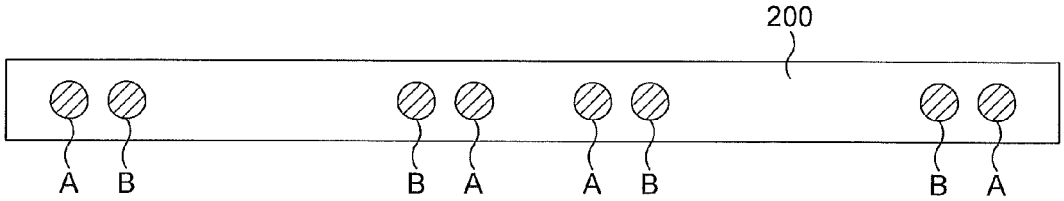
FIG. 29 shows a filter rod.

In one example, each eventual filter rod contains four capsules having a first flavour (capsule type "A") and four capsules having a second flavour (capsule type "B"), arranged in the sequence A-B-B-A-A-B-B-A. The eight capsules may be arranged in four pairs, the separation between capsules in neighbouring pairs being greater than the separation between neighbouring capsules in a pair, for example as shown in the exemplary filter rod 200 of FIG. 29. In cigarette manufacture, such filter rods can be cut into segments and the segments joined to tobacco rods to form "dual capsule" cigarettes, ie: cigarettes which contain two different capsules in each filter. Methods and machines for combining cigarette filters with tobacco rods to make cigarettes are well known per se and will not be described here.

The dual capsule cigarettes thus formed present different choices to the smoker for modifying smoke characteristics. The smoker may selectively rupture either capsule by applying pressure to an area of the cigarette filter surrounding the capsule. Graphical indications may be provided on the outside of the filter to indicate to the smoker where to apply pressure in order to respectively break one capsule or the other. Where for example one of the capsules is a menthol-containing capsule and the other capsule is an orange-essence containing capsule, the smoker may decide to squeeze the filter such that only one of the capsules is broken, thereby selectively flavouring the smoke with either a menthol flavour or an orange-essence flavour. Alternatively, the smoker may rupture both capsules to provide a mixed flavour, or further alternatively may choose to have an unflavoured cigarette, by not rupturing any of the capsules. In some example, both capsules may be positioned closer to the tobacco end of the cigarette than to the mouth end.

Figure 21:
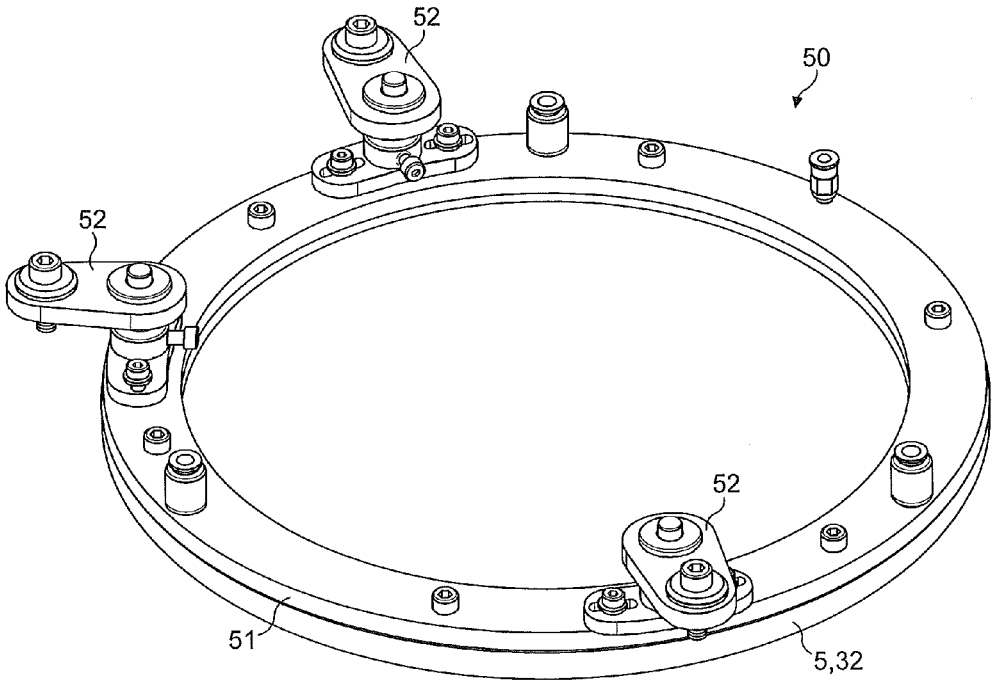
FIGS. 21-23 illustrate a suction ring assembly.
Figure 22:
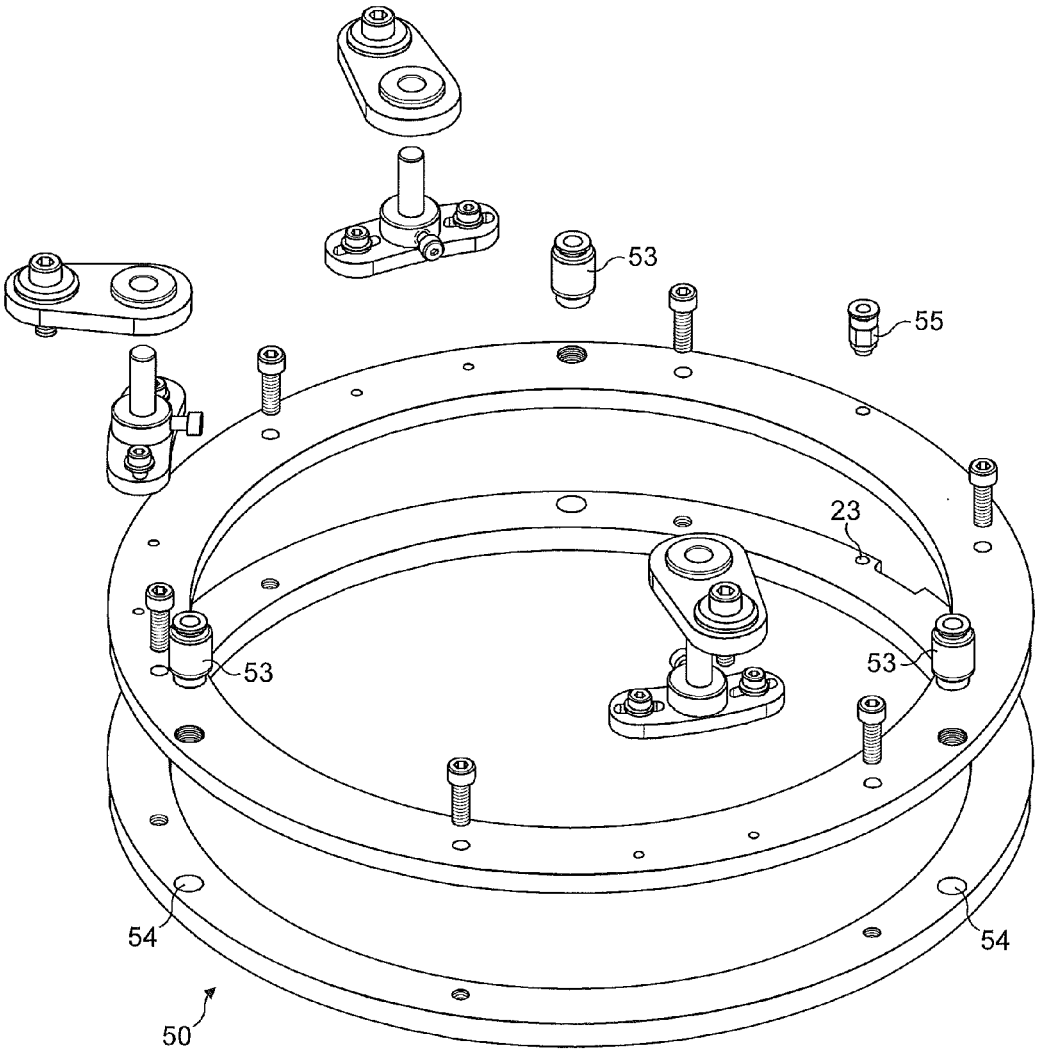
Figure 23:
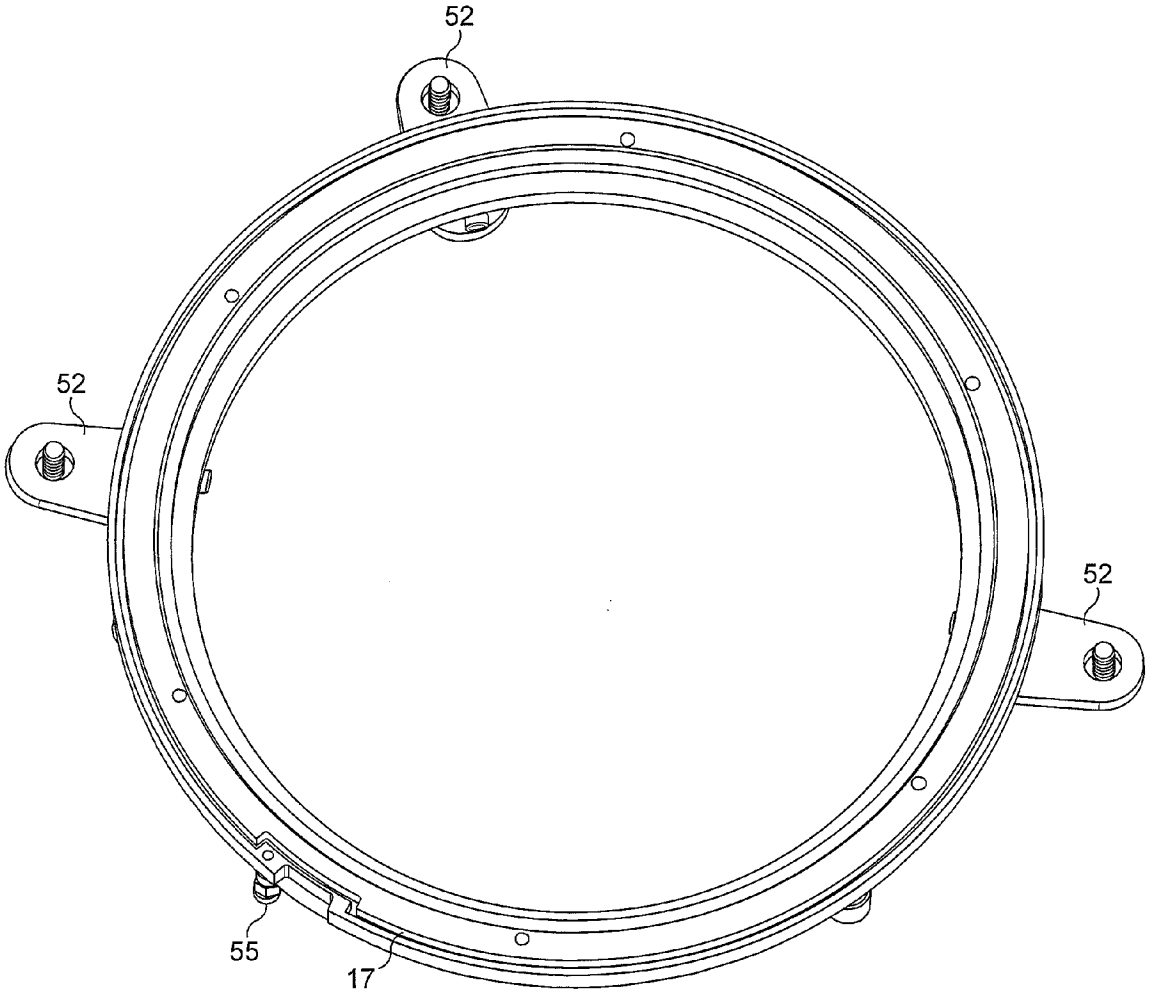

FIGS. 21-23 illustrate an assembly 50 for mounting the suction ring 5, 32. As shown in FIGS. 21-23 the ring 5, 32 is bolted to a mounting ring 51 comprising a plurality of mounts 52 for holding the suction ring 5, 32 in place. The mounting ring 51 includes vacuum connections 53 for connection with a vacuum source. As shown, the vacuum connections are in communication with holes 54 in the ring 5, 32, which in turn are in communication with the vacuum channel 17 in the underside of the ring. In this way, vacuum can be supplied to the vacuum channel 17 via the vacuum connections 53. The mounting ring 51 also includes a compressed air connection 55 for connection with a compressed air source. The compressed air connection is in communication with the ejection port 23 so that compressed air can be supplied to the ejection port for ejecting the capsules.

Figure 26:
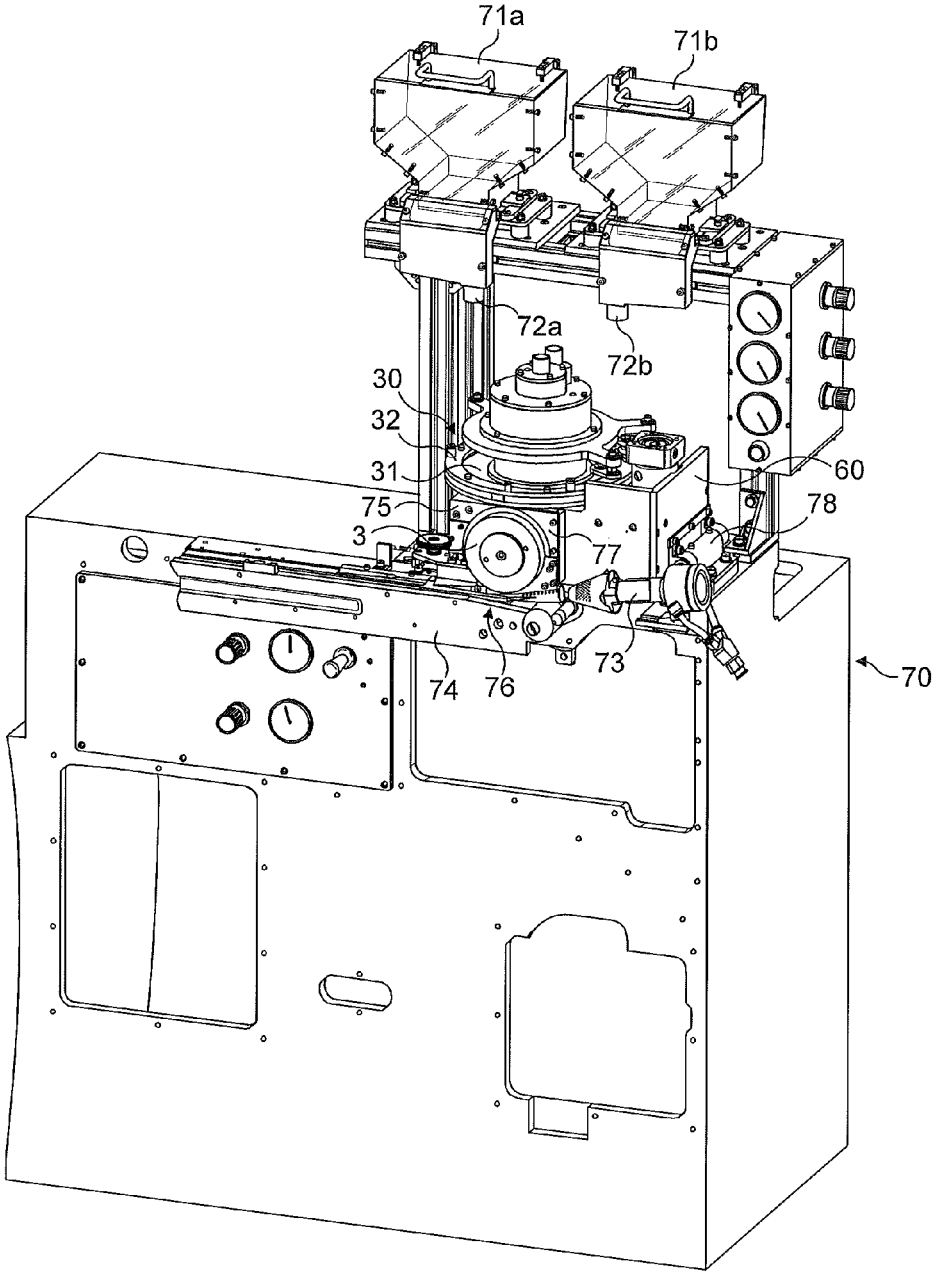
FIG. 26 shows the feed unit of FIG. 11 mounted in a filter maker.

FIG. 26 shows the feed unit 30 in place in a filter maker 70. As shown, the rotary disk 31, suction ring 32, and the wheel 3 of the unit 30 are mounted in place in the maker 70.

In operation of the machine 70, filter plug material in the form of cellulose acetate filter is drawn from a source, stretched in a set of stretching rollers (not shown) and compressed through a stuffer jet 73 and then through a garniture 74. The wheel 3 is arranged to deliver capsules from the pockets 3*a* directly into a tow guide in the form of the tongue 76 of the garniture 74, so that the capsules come into contact with filter tow passing therethrough. The tow is paper wrapped in the garniture to form an elongate rod which is then cut to form filter rod segments, each of which contains a desired number of capsules, for example one, two, three or four.

Referring to FIG. 26, the outlet of the stuffer jet 73 is separated from the input of the garniture 74 by a gap of 10 mm. This helps prevent air from the stuffer jet from flowing into the garniture and getting trapped in the tow, which might otherwise disturb the capsule positioning. Different size gaps may be used for different tow types, since it is expected that more air may be trapped in the tow for heavier tows. This effect can be compensated by increasing the gap. The stuffer jet 73 has a tapered funnel with holes on the end to allow air to escape and this also helps reduce air from the stuffer jet from passing into the tow.

The wheel 3 is rotatably mounted to the body 75 of the machine 70 on a shaft. The tongue 76 is tapered along its length so as to radially compress the filter tow as it passes through the tongue 76. An opening is formed in the top of an inlet portion 79 of the tongue 76, the opening being wide enough to receive the disk section 3*b* of the wheel 3, which penetrates into the tongue 4 through the opening.

The capsules exiting the wheel 3 may drop from the pockets 3*a* of the wheel 6 into the tow passing through the tongue 76. The wheel 3 may have a capsule ejection mechanism, for example an air-jet propulsion mechanism, configured to sequentially eject the capsules from the pockets 3*a* into the tow passing through the tongue 76.

Figure 24:
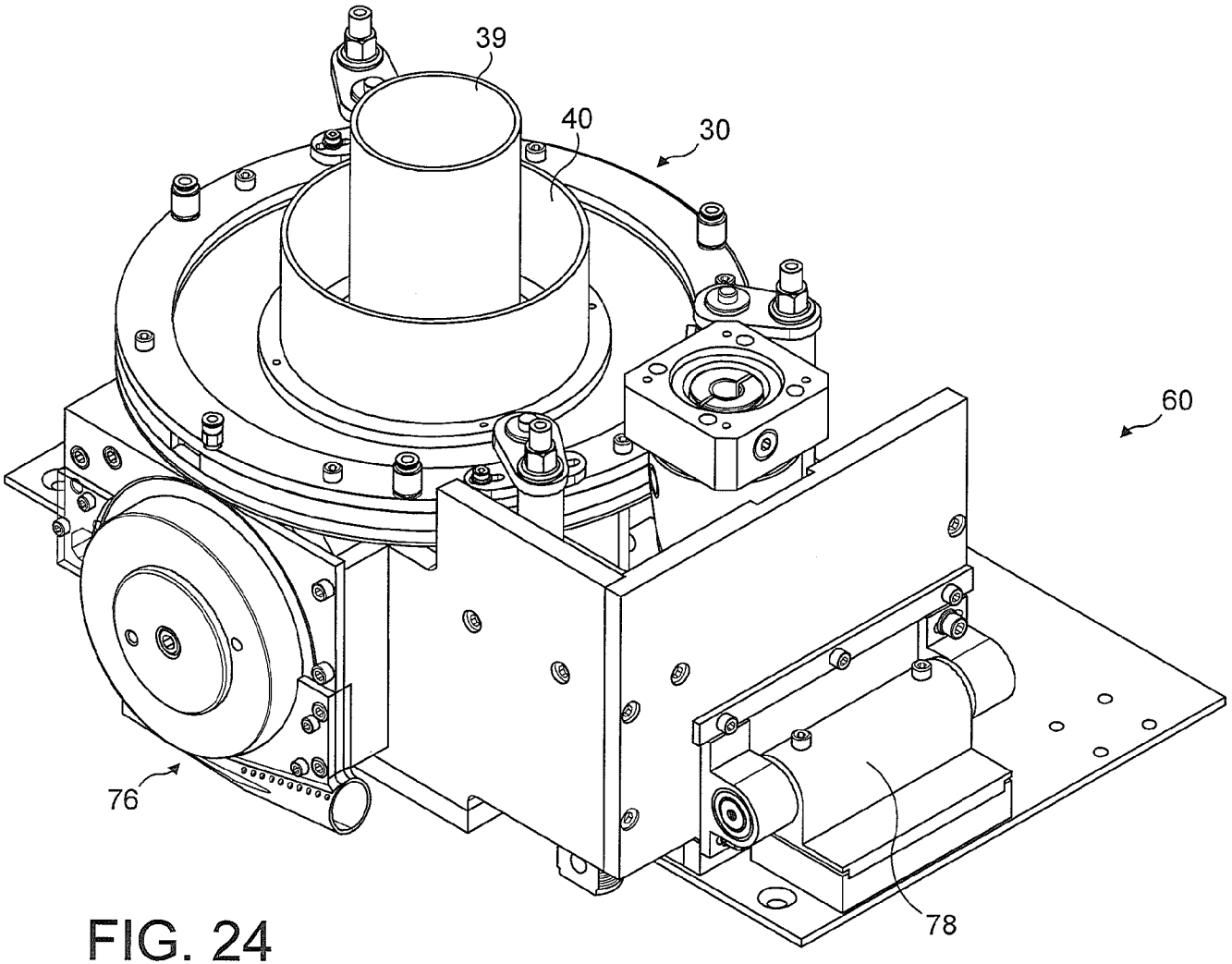
FIGS. 24 and 25 shows an assembly for mounting the feed unit of FIG. 11 to a filter maker.
Figure 25:
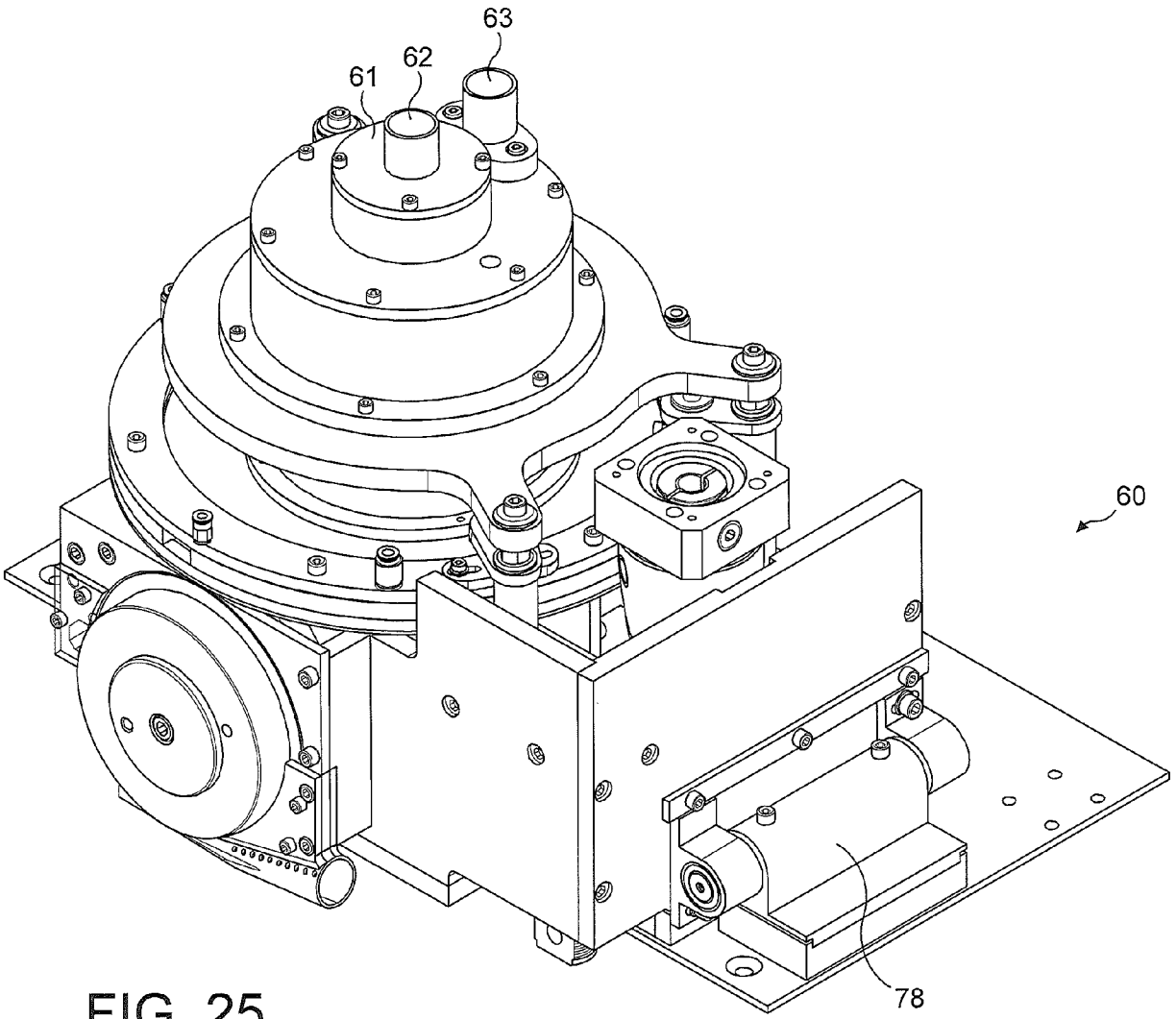

FIG. 24 shows an assembly 60 for mounting the feed unit 30 to filter making machine 70. As shown in FIG. 25, the inner and outer tubes 34*a*, 34*b* may be provided with covers 61 having capsule supply connections 62, 63 respectively arranged to supply capsules to the inputs 39, 40.

As shown in FIG. 26, the machine 70 may be fitted with hoppers 71*a*, 71*b*. Each hoppers has an output 72*a*, 72*b* to feed capsules to the supply connections 62, 63 respectively by way of tubing (not shown). In use, the hoppers 71*a*, 71*b* may be loaded with the same or different capsule types for insertion into the eventual filters. Feeding from multiple hoppers 71*a*, 71*b* permits high speed capsule insertion. In some examples, the hoppers 71*a*, 71*b* may be respectively loaded with capsules containing different flavourants and the cutter may be timed so that each eventual filter rod produced by the machine 70 includes one or more capsules of each type.

Each capsule input 39, 40 may be provided with a level control mechanism including a sensor to monitor the level of capsules in the inputs 39, 40. The level control mechanism may be configured so that capsules are only loaded from the hoppers 71*a*, 71*b* into respective inputs 39, 40 when the level of capsules in the input 39, 40 drops below a predetermined level.

As shown in FIGS. 24-27, the machine 70 has a hinge mechanism which allows part of the machine 70 to be pivoted away for maintenance, and to facilitate threading of the tow from the stuffer jet 73 through the tongue 4 prior to machine start-up. This also allows convenient cleaning of the interior of the tongue 4.

The hinge mechanism comprises a hinge 78 and a lifting cylinder (not shown) passing through a bore in the lower body of the machine. The hinge 78 is arranged so that an upper part 70*a* of the machine 1 can pivot upwards with respect to lower part 70*b* to the lifted position shown in FIG. 27. As shown, the upper part 70*a* includes the feed mechanism 30, the inlet portion 79 of the tongue 76 and the stuffer jet 3. The lower part 70*b* includes a fixed portion 80 of the tongue.

Figure 27:
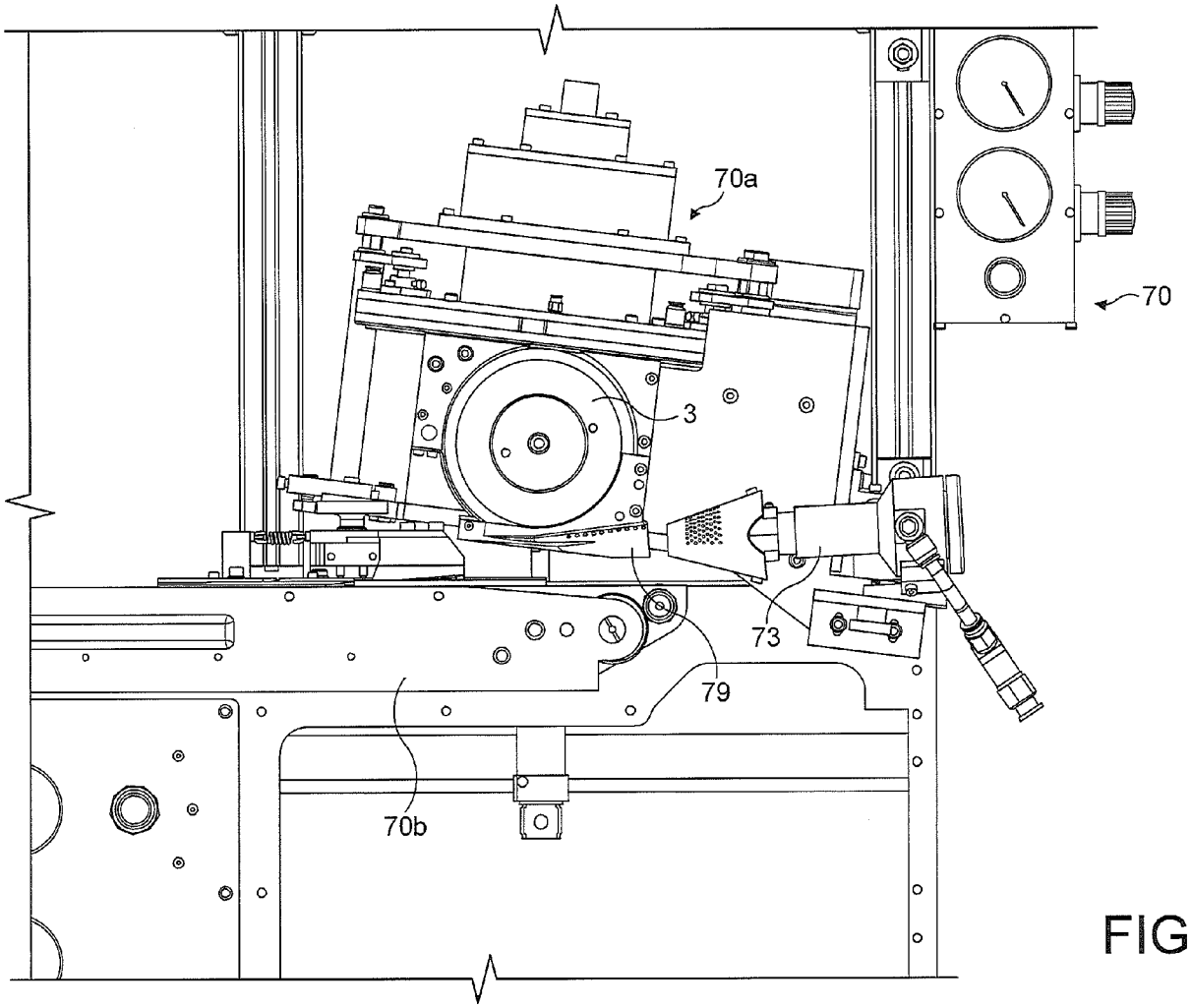
FIG. 27 shows the filter maker with feed unit in a lifted position.

The machine can be selectively positioned in either the position of FIG. 26 or the position of FIG. 27 by raising or lowering the lifting cylinder, which may be hydraulically or pneumatically actuated.

Although FIGS. 24-27 illustrate the feed unit 30 fitted to the filter maker 70, the feed unit could be fitted or retrofitted to any filter maker, for example to existing filter makers.

Many further modifications and variations are possible.

For example, although a pneumatic mechanism in the form of a suction mechanism is described above for holding capsules by negative pressure prior to delivery, this is not intended to be limiting. Alternatively, a pneumatic mechanism in the form of a positive pressure mechanism could be used for this purpose. FIG. 30 illustrates a positive pressure mechanism 85 configured to apply positive pressure to hold the capsules in the rotating channels prior to capsule delivery. As shown, positive air pressure +P1, +P2 from two outlets 86, 87 acts selectively on the outer two capsules 88, 89 in a channel 90. When P1 is on and P2 is off, all capsules are retained in the channel, but when P1 is off and P2 is on, the end capsule 89 drops away. In this way, switching the pressure between the two outlets allows the outermost capsule to drop away whilst retaining the rest in position. The positive air pressure +P1, +P2 may be provided from a compressed air source. However it will be appreciated that gaseous flow other than air may be used to provide positive pressure from the outlets 86, 87.

Further, although a feed mechanism for feeding breakable capsules is described above, variations of the feed mechanism are envisaged to feed other objects suitable for insertion into filter rods. Possible objects for insertion include flavourant beads or pellets, or pieces of charcoal, for example.

Still further, although the feed mechanism is described above in the context of feeding objects for insertion into cigarette filter rods, alternatively the feed mechanisms of the invention may be used to feed suitable objects into tobacco rods, or into other tobacco industry products or components thereof.

Many other modifications and variations will be evident to those skilled in the art, that fall within the scope of the following claims:

The invention claimed is:

1. A feed mechanism to feed objects for insertion into tobacco industry products, the feed mechanism comprising:

a rotary disk to receive objects, the rotary disk defining a plurality of channels, each channel having an outlet to dispense an object assembled in a row in a channel of the plurality of channels from said channel; and a pneumatic mechanism in register with at least one sort formed in at least one of the channels, wherein the pneumatic mechanism prevents an object from passing through the outlet of its respective channel prior to said object being dispensed.

2. The feed mechanism as claimed in claim 1, wherein the pneumatic mechanism is configured to restrict outward movement of objects in a channel from the plurality of channels while an object is being dispensed from said channel.

3. The feed mechanism as claimed in claim 2, wherein the pneumatic mechanism is configured to hold a first object in longitudinal position in said channel while a second object is being dispensed from said channel, wherein the channel is configured such that in use the first object blocks passage of other objects, thereby restricting outward movement of objects in the channel while the second object is being dispensed.

4. The feed mechanism as claimed in claim 1, wherein the pneumatic mechanism comprises a suction mechanism.

5. The feed mechanism as claimed in claim 4, wherein the suction mechanism is configured to release suction so as to allow an object to pass through the outlet of its respective channel when said channel is in a dispensing position, and to apply suction so as to prevent an object from passing through the outlet prior to the object being dispensed.

6. The feed mechanism as claimed in claim 4, wherein:

the outlet is formed in a bottom surface of each channel, the suction mechanism includes one or more intake regions and a suction relief region, the rotary disk is configured to rotate relative to the one or more intake regions and the suction relief region, and each channel has a port configured for alignment with an intake region and with the suction relief region during rotation, the port being formed in a top surface of the channel in register with the channel outlet, such that in use, an object is held by suction above the outlet when the port is aligned with said intake region and such that in use, an object is dispensed from the outlet when the port is aligned with the suction relief region.

7. The feed mechanism as claimed in claim 6, wherein each channel comprises two ports positioned at different longitudinal positions along the channel, wherein the inwardly positioned port is configured to align with an intake region of the suction mechanism when the outwardly positioned port is aligned with the suction relief region, so that in use an object is held in position by suction applied through the inward port while another object is being dispensed.

8. The feed mechanism as claimed in claim 7, wherein the one or more intake regions comprises first and second concentric arc regions, the first arc region being configured to align with the outwardly positioned port and the second arc region being configured to align with the inwardly positioned port.

9. The feed mechanism as claimed in claim 4, wherein the rotary disk is mounted for rotation relative to an intake region of the suction mechanism, and wherein a channel from said plurality of channels includes a port configured to align with the intake region when the channel is in a dispensing position, thereby in use to apply suction through the port for holding a first object in longitudinal position in the channel while a second object is being dispensed from the channel.

10. The feed mechanism as claimed in claim 1, further comprising an object input member configured to receive objects, and an object guide to guide objects from the object input member to the channels.

11. The feed mechanism as claimed in claim 1, wherein the rotary disk comprises:

a first input having a first set of one or more channels extending therefrom such that objects received in the first input are passed only into the first set of one or more channels; and a second input, separate from the first input, having a second set of one or more channels extending therefrom such that objects received in the second input are passed into the second set of one or more channels.

12. The feed mechanism as claimed in claim 11, wherein the rotary disk includes one or more barriers configured to prevent Objects from passing from the first input into any of the channels of the second set and to prevent objects from passing from the second input into any of the channels of the first set.

13. The feed mechanism as claimed in claim 1, wherein one or more of the channels deviate from a radial path.

14. The feed mechanism as claimed in claim 13, wherein an angular separation between the inlets of two neighbouring channels is greater than an angular separation between the outlets of said two neighbouring channels.

15. A filter rod maker comprising a feed mechanism as claimed in claim 1, wherein the fitter rod maker is configured to receive objects from the feed mechanism and manufacture filter rods, each rod having one or more of said received objects therein.

16. The filter rod maker as claimed in claim 15, further comprising:

a garniture configured to receive filter plug material and filter wrapping material and to form a wrapped elongate filter rod, the garniture comprising a tongue; and a cutter configured to cut the wrapped elongate filter rod, thereby forming filter rod segments, each rod segment having one or more objects therein, wherein the feed mechanism comprises a rotary disk and a delivery wheel, wherein the delivery wheel is configured to receive objects from the rotary disk and wherein the delivery wheel is configured to deliver objects directly into the tongue such that objects are inserted into filter plug material passing through the tongue.

17. The filter rod maker as claimed in claim 16, wherein the delivery wheel penetrates into the tongue such that each object received by the delivery wheel exits an object-transport member at an exit point inside the tongue.

18. The feed mechanism as claimed in claim 1, wherein the objects are breakable fluid-containing capsules.

19. The feed mechanism as claimed in claim 1, the apparatus further comprising a delivery wheel, the rotary disk comprising said channels and the delivery wheel being configured to receive objects dispensed from the rotary disk, wherein the rotary disk is configured for rotation about a first axis and the delivery wheel is configured for rotation about a second axis transverse to the first axis.

20. The feed mechanism as claimed in claim 19, further comprising a synchronisation member configured to rotate the rotary disk and delivery wheel such that a tangential velocity of the rotary disk is substantially equal to a tangential velocity of the delivery wheel at a point of object transfer from the rotary disk to the delivery wheel.

21. A method of feeding objects for insertion into tobacco industry products, the method comprising:

rotating a rotary disk that defines a plurality of channels therein, such that objects assemble in rows in the channels which rotate with the rotary disk;

holding an object in a channel of the plurality of channels by positive or negative pressure to prevent said object passing through an outlet in its respective channel prior to that object being dispensed from the channel; and dispensing said object.

22. The method as claimed in claim 21, further comprising applying positive or negative pressure to restrict outward movement of at least one of the objects in a respective channel from the plurality of channels while another of the objects in said channel is being dispensed.

23. The method as claimed in claim 21, further comprising successively dispensing objects from successive channels.

* * * * *

UNITED STATES PATENT AND TRADEMARK OFFICE

CERTIFICATE OF CORRECTION

PATENT NO. : 9,089,163 B2
APPLICATION NO. : 13/990174
DATED : July 28, 2015
INVENTOR(S) : Gerhard Le Roux It is certified that error appears in the above-identified patent and that said Letters Patent is hereby corrected as shown below:

In the Claims:

Column 14, line 41, claim 1

"sort" should read -- port --

Signed and Sealed this
Ninth Day of February, 2016

Michelle K. Lee

Michelle K. Lee
*Director of the United States Patent and Trademark Office*